US011554288B2

(12) United States Patent
Lagree et al.

(10) Patent No.: US 11,554,288 B2
(45) **Date of Patent: *Jan. 17, 2023**

(54) EXERCISE MACHINE

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 177 days.

This patent is subject to a terminal disclaimer.

(21) Appl. No.: 17/113,306

(22) Filed: Dec. 7, 2020

(65) Prior Publication Data

US 2021/0086023 A1 Mar. 25, 2021

Related U.S. Application Data

(63) Continuation of application No. 15/854,242, filed on Dec. 26, 2017, now Pat. No. 10,857,418.
(Continued)

(51) Int. Cl.
*A63B 21/00* (2006.01)
*A63B 21/008* (2006.01)

(52) U.S. Cl.
CPC .... *A63B 21/4047* (2015.10); *A63B 21/00069* (2013.01); *A63B 21/4027* (2015.10);
(Continued)

(58) Field of Classification Search
None
See application file for complete search history.

(56) References Cited

U.S. PATENT DOCUMENTS 1,621,477 A 8/1925 Pilates
1,866,868 A 7/1932 Thomson
(Continued)

FOREIGN PATENT DOCUMENTS

EP 0354785 A2 2/1990
WO 2004/096376 A1 11/2004

OTHER PUBLICATIONS

PCT International Preliminary Report on Patentability for PCT/US2017/068409; dated Jul. 4, 2019.
(Continued)

*Primary Examiner* — Sundhara M Ganesan
*Assistant Examiner* — Shila Jalalzadeh Abyaneh
(74) *Attorney, Agent, or Firm* — Neustel Law Offices

(57) ABSTRACT

An exercise machine which is capable of having its lift, roll, or pitch adjusted with respect to a base so as to provide a plurality of positions of the exercise machine with respect to the base. The exercise machine generally includes a base and an exercise machine movably connected to the base. The exercise machine may include a track, a carriage slidably connected to the track, and a biasing member attached to the carriage to apply a resistive force to the carriage. A plurality of actuators may be connected between the base and the exercise machine. The plurality of actuators may be utilized to adjust a pitch angle or a roll angle of the exercise machine with respect to the base. The plurality of actuators may also be utilized to lift or lower the exercise machine at a constant angle of pitch and/or roll inclination.

19 Claims, 20 Drawing Sheets

Related U.S. Application Data

(60) Provisional application No. 62/438,542, filed on Dec. 23, 2016.

(52) U.S. Cl.
CPC ..... *A63B 21/008* (2013.01); *A63B 21/4031* (2015.10); *A63B 21/4045* (2015.10)

(56) References Cited

U.S. PATENT DOCUMENTS 3,770,267 A 11/1973 McCarthy
4,240,627 A 12/1980 Brentham
4,759,540 A 7/1988 Yu
4,798,378 A 1/1989 Jones
5,035,418 A * 7/1991 Harabayashi ..... A63B 22/16 482/57
5,066,005 A 11/1991 Luecke
5,263,913 A 11/1993 Boren
5,385,519 A 1/1995 Hsu
D362,700 S 9/1995 Breibart
D382,319 S 8/1997 Gerschefske
5,681,249 A 10/1997 Endelman
5,782,639 A 7/1998 Beal
5,820,478 A 10/1998 Wood
5,885,197 A 3/1999 Barton
5,895,340 A 4/1999 Keller
5,944,615 A 8/1999 Lee
5,967,955 A 10/1999 Westfall
6,179,753 B1 1/2001 Barker
6,243,897 B1 6/2001 Sumiya
6,505,363 B2 1/2003 Davis
6,761,667 B1 7/2004 Cutler
6,796,927 B2 9/2004 Toyama
7,131,911 B2 11/2006 Kim
7,163,500 B2 1/2007 Endelman
7,270,628 B2 9/2007 Campanaro
7,530,929 B2 5/2009 Feldman
7,803,095 B1 9/2010 Lagree
7,857,732 B2 12/2010 Nielson
7,931,570 B2 4/2011 Hoffman
7,935,032 B1 5/2011 Jackson
8,012,073 B2 9/2011 Barnett
8,192,332 B2 6/2012 Baker
8,249,714 B1 8/2012 Hartman
8,356,996 B2 1/2013 Mayrhofer
8,641,585 B2 2/2014 Lagree
8,734,307 B2 5/2014 Bathey
8,764,609 B1 7/2014 Elahmadie
8,858,409 B2 10/2014 Trees
9,011,264 B2 4/2015 Tang
9,038,218 B1 5/2015 Heil
9,050,517 B2 6/2015 Oliver
9,125,785 B2 9/2015 Trees
9,132,051 B2 9/2015 Heil
9,339,712 B2 5/2016 De Biasi
9,539,462 B2 1/2017 Carter
10,046,193 B1 8/2018 Aronson
2001/0056011 A1 12/2001 Endelman
2002/0022551 A1 2/2002 Watterson
2002/0128084 A1 9/2002 Lee
2002/0144350 A1 10/2002 Shih
2003/0078138 A1 4/2003 Toyama
2003/0119635 A1 6/2003 Arbuckle
2004/0077464 A1 4/2004 Feldman
2004/0248710 A1 12/2004 Rodgers, Jr.
2005/0113182 A1 5/2005 Kim
2005/0130810 A1 6/2005 Sands
2005/0164856 A1 7/2005 Parmater
2006/0046914 A1 3/2006 Endelman
2006/0172862 A1 8/2006 Badameh
2006/0199712 A1 9/2006 Barnard
2006/0211543 A1 9/2006 Feldman
2006/0293156 A1 12/2006 Trees
2007/0191128 A1 8/2007 Tirol
2008/0070765 A1 3/2008 Brown
2008/0242511 A1 10/2008 Munoz
2008/0248935 A1 10/2008 Solow
2009/0023556 A1 1/2009 Daly
2009/0209393 A1 8/2009 Crater
2010/0227748 A1 9/2010 Campanaro
2011/0009249 A1 1/2011 Campanaro
2011/0082016 A1 4/2011 Kim
2011/0143898 A1* 6/2011 Trees ..... A61G 7/16 482/142
2011/0152032 A1 6/2011 Barnett
2011/0166002 A1 7/2011 Savsek
2011/0172069 A1 7/2011 Gerschefske
2012/0071301 A1* 3/2012 Kaylor ..... A63B 21/00058 482/57
2012/0088634 A1 4/2012 Heidecke
2012/0295771 A1 11/2012 Lagree
2013/0150219 A1 6/2013 Chang
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2015/0011362 A1 1/2015 Oh
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1* 12/2015 Lagree ..... A63B 24/0084 482/142
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0043210 A9 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 7/2017 Lagree
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree

(56) References Cited

U.S. PATENT DOCUMENTS

| | | | |
|---|---|---|---|
| 2017/0326406 | A1 | 11/2017 | Lagree |
| 2017/0340947 | A1 | 11/2017 | Lagree |
| 2017/0354840 | A1 | 12/2017 | Lagree |

OTHER PUBLICATIONS

PCT International Search Report and Written Opinion for PCT/US17/68409; Received and Printed Mar. 20, 2018.
Vww.SolidMasters.com Website Page via Archive.org; Jul. 7, 2014.
Picture from www.SolidMasters.com Page via Archive.org; Jul. 7, 2014.
PCT International Search Report and Written Opinion; Received and Printed Dec. 15, 2016.
http://www.walmart.com/ip/total-gym-1400/23816097?adid=150000000000027727770; Webpage from Walmart.com for the Total Gym 1400; Received and Printed Aug. 25, 2014.

* cited by examiner

| | Exercise Plane Positions | Actuator 101 | Actuator 102 | Actuator 103 | Actuator 104 |
|---|---|---|---|---|---|
| 0 | Default - Horizontal, Tilt and Roll = Zero | Level 1 | Level 1 | Level 1 | Level 1 |
| 1 | Front Tilt Up, Roll = Zero | Level 1 | Level 1 | Level 2 | Level 2 |
| 2 | Back Tilt Up, Roll = Zero | Level 2 | Level 2 | Level 1 | Level 1 |
| 3 | Front Left Up (far side), Roll = Counterclockwise | Level 1 | Level 2 | Level 2 | Level 3 |
| 4 | Front Right Up (near side), Roll = Clockwise | Level 2 | Level 1 | Level 3 | Level 4 |
| 5 | Back Left Up (far side), Roll = Clockwise | Level 2 | Level 3 | Level 1 | Level 2 |
| 6 | Back Right Up (near side), Roll = Counterclockwise | Level 3 | Level 2 | Level 2 | Level 1 |

508

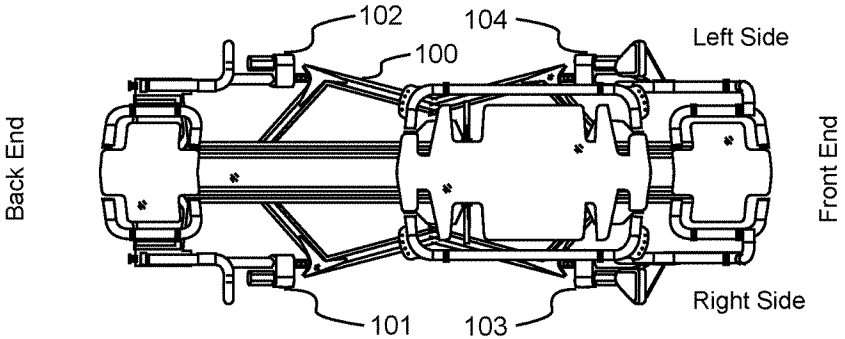

TOP VIEW

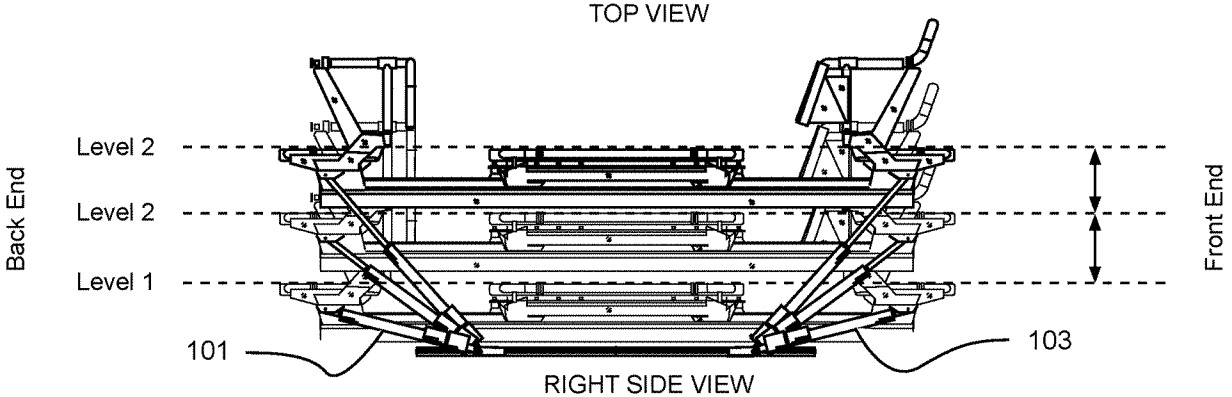

RIGHT SIDE VIEW

FIG. 20

EXERCISE MACHINE

CROSS REFERENCE TO RELATED APPLICATIONS

The present application is a continuation of U.S. application Ser. No. 15/854,242 filed on Dec. 26, 2017 which issues as U.S. Pat. No. 10,857,418 on Dec. 8, 2020, which claims priority to U.S. Provisional Application No. 62/438,542 filed Dec. 23, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine which is capable of having its lift, roll, and/or pitch adjusted with respect to a base so as to provide a plurality of positions of the exercise machine with respect to the base.

Related Art

Any discussion of the related art throughout the specification should in no way be considered as an admission that such related art is widely known or forms part of common general knowledge in the field.

The exercise field is well known. Those skilled in the art will appreciate that traditional exercise machines with a sliding, substantially horizontal exercise platform, such as a Pilates machine, are intended to maintain a stable and substantially horizontal surface upon which to exercise. Fitness trainers have long known that repeatedly exercising on the same type of machine promotes what is referred to as muscle memory, the condition wherein various muscle-related tasks are easier to perform after previous practice, even if the task has not been performed for a while. It is as if the muscles "remember". Further, trainers have long understood that to break the muscle memory cycle, it is beneficial to continually change the types of exercises and/or types of exercise machines.

Traditional exercise machines that cannot be substantially changed therefore fail to provide the variations needed to prevent or break the muscle memory cycle.

Fitness trainers will readily appreciate the training benefits of a machine that could continually be changed throughout an exercise routine as a means to continually stimulate new muscles, and prevent muscle memory.

SUMMARY

An example embodiment is directed to an exercise machine. The exercise machine includes a base and an exercise machine movably connected to the base. The exercise machine may include a track, a carriage slidably connected to the track, and a biasing member attached to the carriage to apply a resistive force to the carriage. A plurality of actuators may be connected between the base and the exercise machine. The plurality of actuators may be utilized to adjust a pitch angle or a roll angle of the exercise machine with respect to the base. The plurality of actuators may also be utilized to lift or lower the exercise machine at a constant angle of pitch and/or roll inclination.

There has thus been outlined, rather broadly, some of the embodiments of the exercise machine in order that the detailed description thereof may be better understood, and in order that the present contribution to the art may be better appreciated. There are additional embodiments of the exercise machine that will be described hereinafter and that will form the subject matter of the claims appended hereto. In this respect, before explaining at least one embodiment of the exercise machine in detail, it is to be understood that the exercise machine is not limited in its application to the details of construction or to the arrangements of the components set forth in the following description or illustrated in the drawings. The exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 20 is an exemplary diagram of two views of an improved exercise machine and table of actuator positions to change the plane of exercise in accordance with an example embodiment.

DETAILED DESCRIPTION

Figure 1:
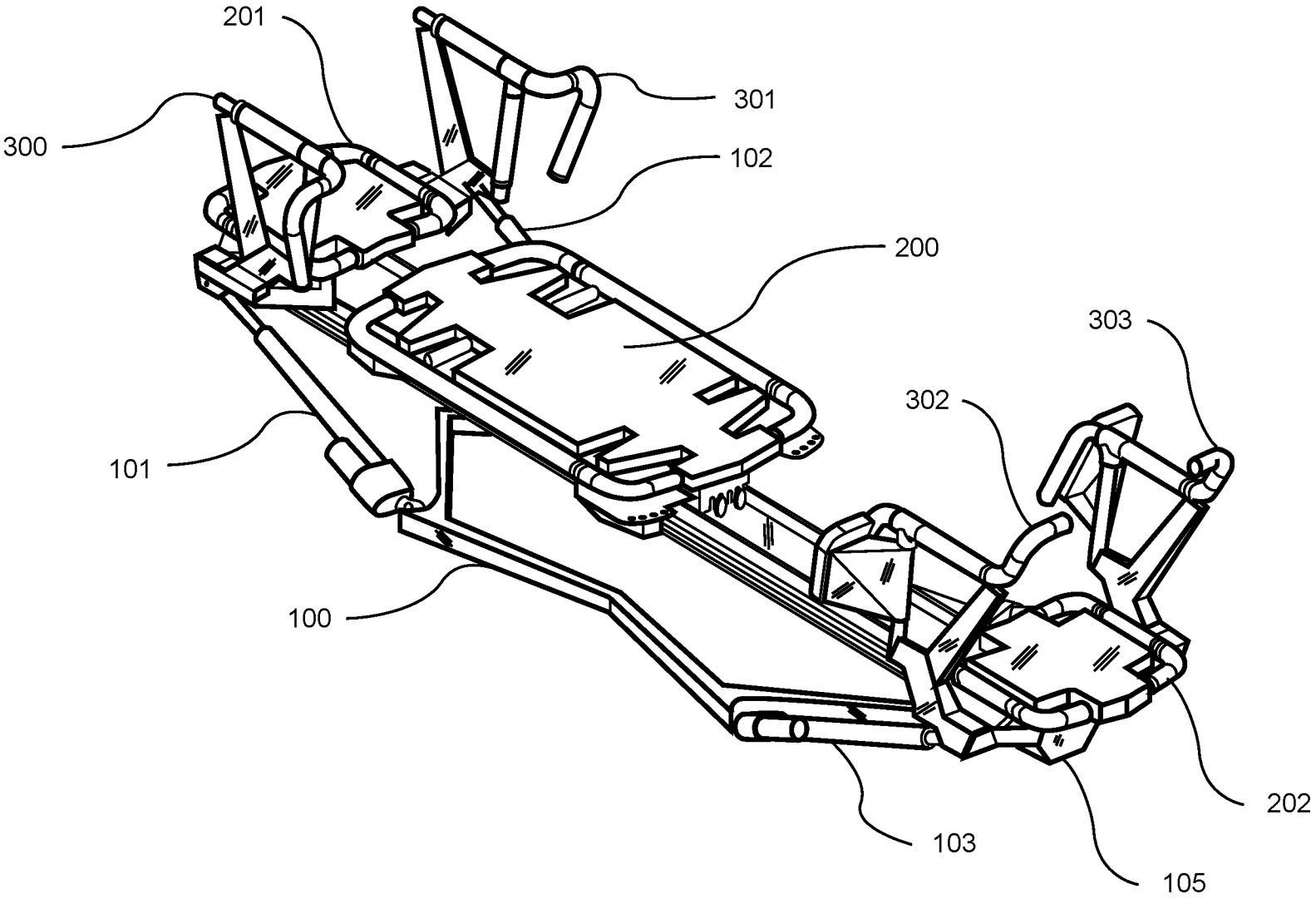
FIG. 1 is an exemplary diagram showing an isometric view of an improved exercise machine in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

Although more than one embodiment is illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

As shown throughout the figures, an exemplary embodiment may comprise a base 100 and an exercise machine 600 movably connected to the base 100. The exercise machine may comprise a track 105, 108, a carriage 200, 205 slidably connected to the track 105, 108, and a biasing member 106 attached to the carriage 200, 205 to apply a resistive force to the carriage 200, 205.

A plurality of actuators 101, 102, 103, 104 may be connected between the base 100 and the exercise machine 600. The plurality of actuators 101, 102, 103, 104 may be adapted to adjust the exercise machine 600 with respect to the base 100. More specifically, the plurality of actuators 101, 102, 103, 104 may be adapted to rotate the exercise machine 600 about up to two axes (pitch and roll) as well as lift or lower the exercise machine 600 along a vertical axis with respect to the base 100.

The plurality of actuators 101, 102, 103, 104 may be operable to lift or lower the exercise machine 600 along a vertical axis at a constant level of inclination with respect to the base 100. The plurality of actuators 101, 102, 103, 104 may be operable to move the exercise machine 600 about a first axis with respect to the base 100. In some embodiments, the plurality of actuators 101, 102, 103, 104 may also be operable to move the exercise machine 600 about a second axis with respect to the base 100. By way of example, the first axis could comprise a pitch axis of the exercise machine 600, and the second axis could comprise a roll axis of the exercise machine 600, or vice versa.

The exercise machine 600 may include a first platform 201, 206 near a first end of the exercise machine 600 and a second platform 202, 207 near a second end of the exercise machine 600. The plurality of actuators 101, 102, 103, 104 may be operable to lift or lower the first platform 201, 206 and the second platform 202, 207 along a vertical axis with respect to the base 100.

The plurality of actuators 101, 102, 103, 104 may comprise a first actuator 101 connected between a first end of the base 100 and a first end of the exercise machine 600 and a second actuator 103 connected between a second end of the base 100 and a second end of the exercise machine 600. The plurality of actuators 101, 102, 103, 104 may also comprise a third actuator 102 connected between a first end of the base 100 and a first end of the exercise machine 600 and a fourth actuator 104 connected between a second end of the base 100 and a second end of the exercise machine 600.

A plurality of articulating connectors 113 may be utilized to connect each of the plurality of actuators 101, 102, 103, 104 to the exercise machine 600. The articulating connectors 113 may also be utilized to connect each of the plurality of actuators 101, 102, 103, 104 to the base 100. Extension of each of the actuators 101, 102, 103, 104 together may be operable to lift the exercise machine 600 with respect to the base 100. Retraction of each of the plurality of actuators 101, 102, 103, 104 may be operable to lower the exercise machine 600 with respect to the base 100.

In some embodiments, a controller 500 may be communicatively interconnected with each of the plurality of actuators 101, 102, 103, 104. A mobile device 502 such as a laptop computer, smart phone, tablet, or the like may be adapted to transmit a signal to the controller 500 for adjusting each of the plurality of actuators 101, 102, 103, 104. In some embodiments, a wired device 501 such as a remote control may be connected to the controller 500 for adjusting each of the plurality of actuators 101, 102, 103, 104.

An exemplary method of exercising on an exercise machine 600 may comprise the steps of providing an exercise machine 600 movably connected to a base 100 as described herein and positioning an exerciser 400 on the exercise machine 600 to perform a first exercise. The exercise machine 600 may be moved about a pitch axis in a first direction and about a roll axis in a second direction, as well as lifted along a vertical axis at a constant angle of inclination with respect to the base 100 to a lifted position. The exerciser 400 may perform the first exercise during or after the steps of moving and lifting the exercise machine 600.

In an exemplary embodiment, the exercise machine 600 may be pivoted about the pitch axis in the second direction to a second position; with the second position having a different attitude with respect to the first position. The exerciser 400 may perform a second exercise during or after the step of pivoting the exercise machine 600.

In another exemplary embodiment, the exercise machine 600 may be pivoted about the roll axis in the second direction to a second position; with the second position having a different attitude with respect to the first position. The exerciser 400 may perform a second exercise during or after the step of pivoting the exercise machine 600.

In yet another exemplary embodiment, the exercise machine 600 may be lowered along a vertical axis with respect to the base to a lowered position; with the lowered position having a different altitude with respect to the lifted position. The exerciser 400 may perform a second exercise during or after the step of pivoting the exercise machine 600.

FIG. 1 is an exemplary diagram showing an isometric view of an improved exercise machine comprising a base 100, a first actuator 101, a second actuator 103, a third actuator 102 and a fourth actuator 104 which is not shown in FIG. 1 because it is obscured by the exercise machine 600 in the isometric perspective. The ends of the actuators 101, 102, 103, 104 distal to the base 100 may be rotationally affixed to an exercise machine 600 comprising a movable carriage 200 a first platform 201, a second platform 202, a back right handle assembly 300, a front right handle assembly 302, a back left handle assembly 301, a front left handle assembly 303, and a track 105 such as a longitudinal beam assembly extending substantially the length of the machine between the first platform 201, and the second platform 202.

The type of actuator 101, 102, 103, 104 used may vary in different embodiments. The actuators 101, 102, 103, 104 may be motorized. The actuators 101, 102, 103, 104 may comprise any device used to create linear motion by moving an extensible/retractable first portion of an actuator relative to a second portion of the actuator; the distal ends of the first and second portions being affixed to a first and second structure of an exercise machine 600. The exemplary types of actuators 101, 102, 103, 104 shown and described herein are not intended to be limiting, and may comprise one or more types of actuators well known to those skilled in the art including, but not limited to linear, electrical, mechanical, pneumatic, hydraulic, and/or electromechanical actuators.

In practice, the movable carriage 200 may be slidable substantially the distance between the proximate edges of the opposed platforms 201, 202. The movable carriage 200, which may include a plurality of wheels not shown but which will be later described, may be slidable upon a track 105, such as pair of rails affixed to the lateral sides of a beam assembly.

A biasing force is applied to the movable carriage 200 so as to create exercise resistance when an exerciser 400 moves the carriage against the biasing force; the biasing force thereby created by removably attaching at least one biasing member 106 between the movable carriage and preferably one end of the beam assembly. The biasing members 106 may comprise one or more springs, elastic bands, electromagnetic devices capable of creating variable resistance, an eddy current brake, a friction inducing clutch, or other resistance inducing devices and methods that create a resistive force substantially linearly and substantially aligned with the longitudinal axis of the exercise machine 600. In some embodiments, the biasing members 106 may be positioned within the internal area of the track 105 such as a beam assembly.

Figure 2:
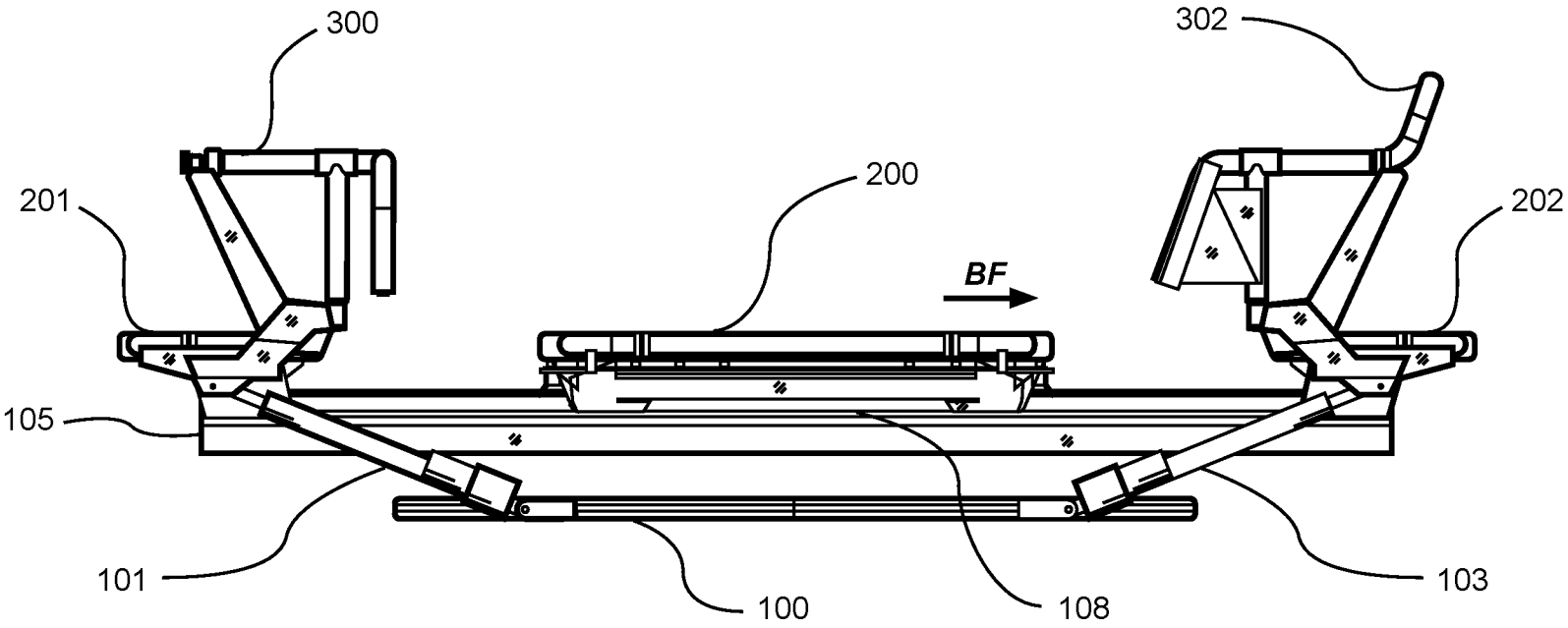
FIG. 2 is an exemplary diagram showing a right side view of an improved exercise machine in accordance with an example embodiment.

FIG. 2 is an exemplary diagram showing a right side view of an improved exercise machine 600. An exercise machine 600 is comprised of a track 105 extending substantially the length of the machine, a second platform 202 centered over the central axis of the track 105, a front right handle assembly 302 and a front left handle assembly 303 consisting of substantially a mirror image of the right handle assembly 302 are respectively positioned lateral to the right and left ends of the first platform 201. A back right handle assembly 300, and substantially a mirror image of the back right handle assembly are respectively positioned lateral to the right and left ends of the first platform 201. The exercise machine is supported by a back right linear actuator 101 and back left linear actuator not shown, a front right linear actuator 103 and front left linear actuator not shown, one end of each actuator rotatably affixed to a base support structure 100, and the opposed distal ends of each actuator rotatably affixed to the upper structure proximate to the opposed ends of the beam assembly.

A movable carriage 200 may be slidable along a track 108 formed of parallel sliding rails affixed to each lateral edge of a beam assembly; the rails extending parallel to and substantially the length of the beam assembly. In practice, a biasing force BF may be applied to the movable carriage 200 by one or more biasing members 106; one end of the biasing members 106 being removably attached to the movable carriage 200, and an opposed end of the biasing members 106 affixed to the exercise machine 600.

Figure 3A:
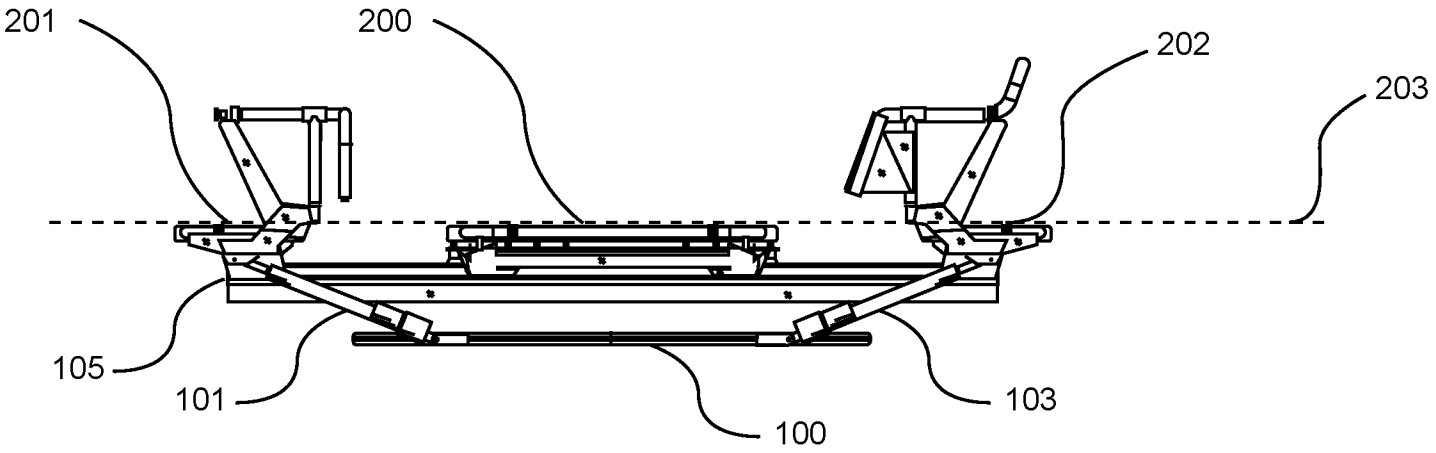
FIG. 3A is an exemplary diagram showing a right side view of an improved exercise machine in a lowered position in accordance with an example embodiment.

FIG. 3A is an exemplary diagram showing a right side view of an improved exercise machine in a lowered position. In the drawing, the horizontal plane of the first and second platforms 201, 202 and the movable carriage 200 when the exercise machine 600 is in a lowered starting position substantially comprising a horizontal plane 203. In the lowered position, the actuators 101, 102, 103, 104 are retracted so as to minimize the vertical distance between the base 100 and the track 105.

Figure 3B:
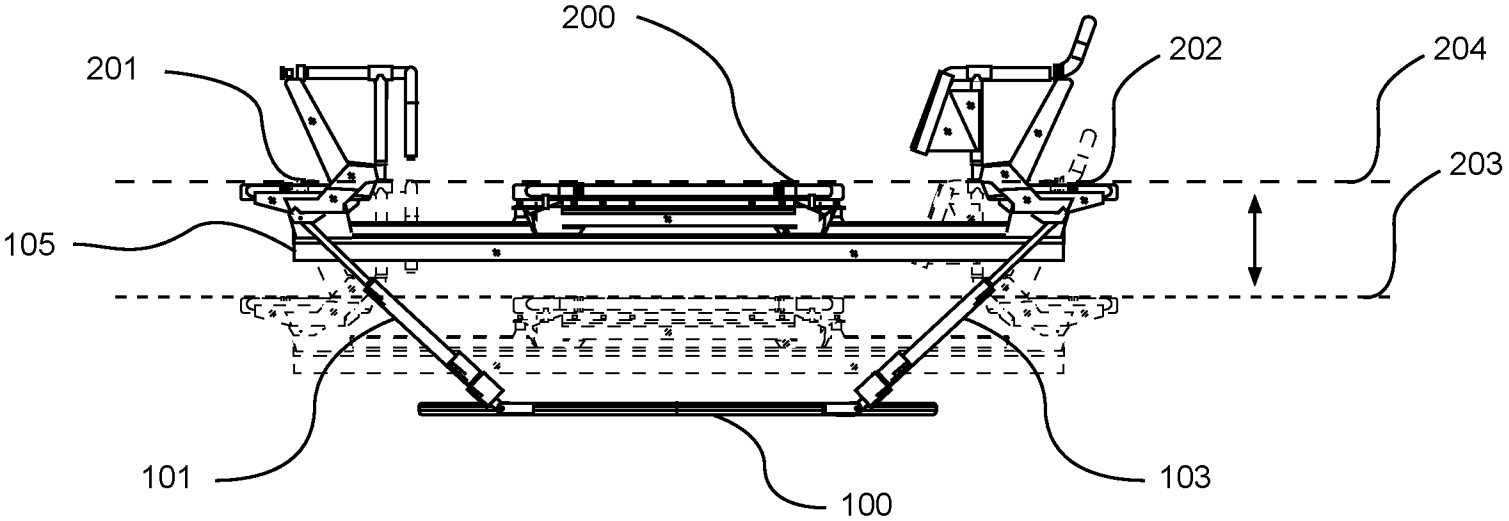
FIG. 3B is an exemplary diagram showing a right side view of an improved exercise machine in a raised position in accordance with an example embodiment.

FIG. 3B is an exemplary diagram showing a right side view of an improved exercise machine 600 in a raised position. The lowered starting position of the substantially horizontal plane 203 of the platforms 201, 202 can be readily seen. It is sometimes preferable to change the position of the exercise machine 600 to perform certain exercises. In FIG. 3B, the actuators 101, 102, 103, 104 are rotatably connected between the base 100 and the substantially opposed ends of the exercise machine 600 are shown extended following actuation. The extended actuators 101, 102, 103, 104 increase the vertical distance between the base 100 and the exercise machine 600; thereby changing the substantially horizontal plane of the platforms just described to a new elevation indicated by a second dashed line 204. Thus, the exercise machine 600 has been lifted along a vertical axis with respect to the base 100.

FIGS. 3A and 3B illustrate the lifting and lowering of the exercise machine 600 with respect to the base 100 along a vertical axis. It should be appreciated that the exercise machine 600 may maintain a constant angle of inclination (roll or pitch) as it is being lifted or lowered with respect to the base 100. For example, if the exercise machine 600 is pitched at an angle, the pitch angle will be maintained as the exercise machine 600 is lifted or lowered with respect to the base 100.

As another example, if the exercise machine 600 is rolled at an angle, the roll angle will be maintained as the exercise machine 600 is lifted or lowered with respect to the base 100. As yet another example, if the exercise machine 600 is both rolled and tilted at an angle, both the roll and tilt angle may be maintained uniformly as the exercise machine 600 is lifted or lowered with respect to the base 100.

This may be accomplished by maintaining uniform extension/retraction of the actuators 101, 102, 103, 104 (same velocity and acceleration) while retaining the relative positioning of the actuators 101, 102, 103, 104 as the actuators 101, 102, 103, 104 are extended or retracted. For example, if the first actuator 101 and second actuator 103 are both extended by twenty percent, and the third actuator 102 and fourth actuator 104 are both extended by zero percent, the exercise machine 600 would be lifted or lowered at a constant angle of inclination by uniformly extending the four actuators 101, 102, 103, 104 a uniform distance at a uniform speed; with the first and second actuators 101, 103 starting movement from the twenty percent extended position at the same time as the third and fourth actuators 102, 104 start movement from the zero percent extended position.

Figure 4:
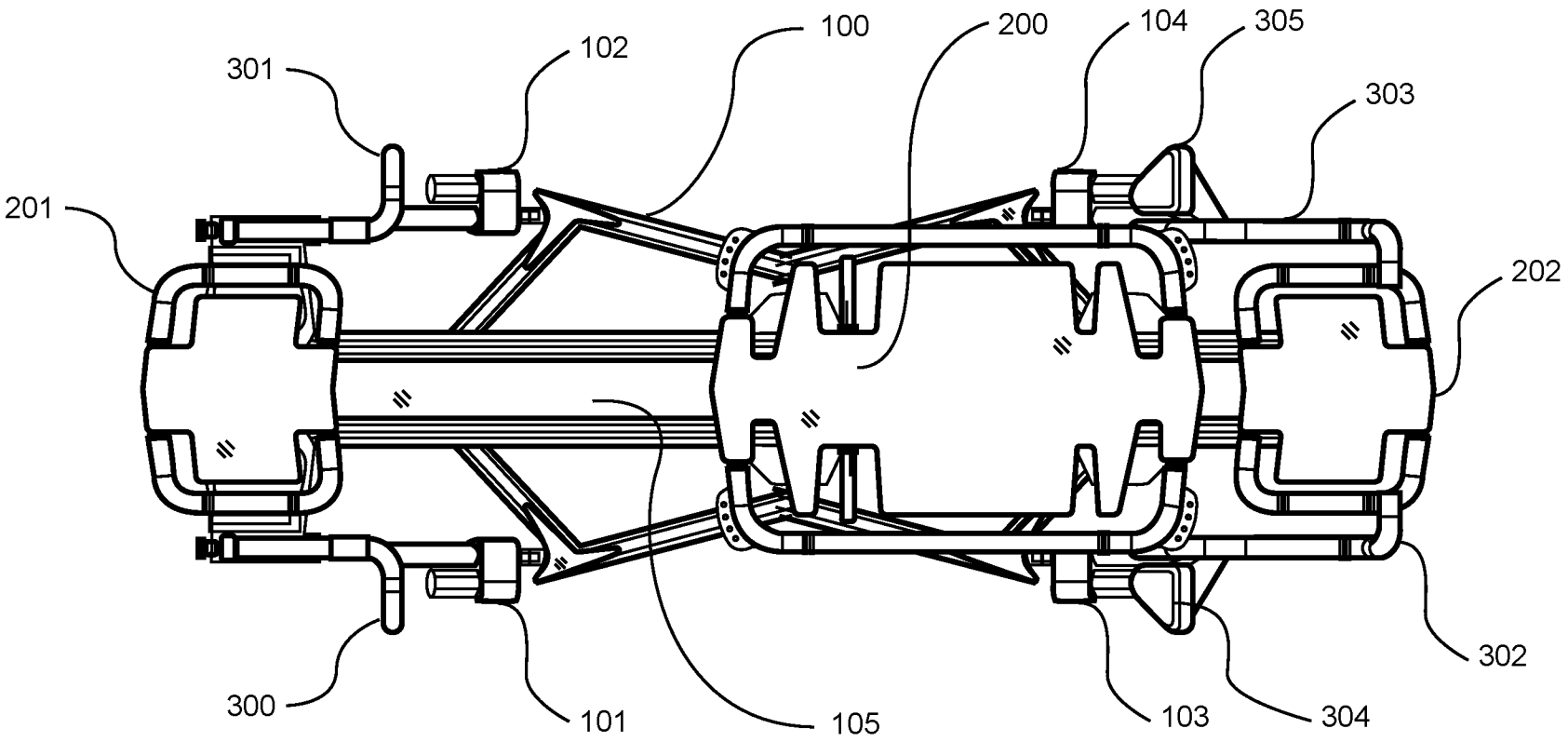
FIG. 4 is an exemplary diagram showing a top view of an improved exercise machine in accordance with an example embodiment.

FIG. 4 is an exemplary diagram showing a top view of an improved exercise machine. One end of each of four actuators 101, 102, 103, 104 are rotatably attached to a base 100, and the opposed ends of the actuators 101, 102, 103, 104 are rotatably affixed to the exercise machine 600; the points of connection being obscured by certain elements of the exercise machine 600. A pair of platforms 201, 202 is affixed to substantially opposed ends of the exercise machine 600.

The back right and left handle assemblies 300, 301 are affixed to their respective sides of the first platform 201, and a front right and left handle assembly 302, 303 are affixed to their respective sides of the second platform 202. A right push pad 304 may be affixed to the front right handle assembly 302, and a left push pad 305 may be affixed to the front left handle assembly 303. A movable carriage 200 may be slidably affixed to the exercise machine 600 which is adapted to slide reciprocally substantially the length of the exercise machine 600 between the platforms 201, 202.

Figure 5:
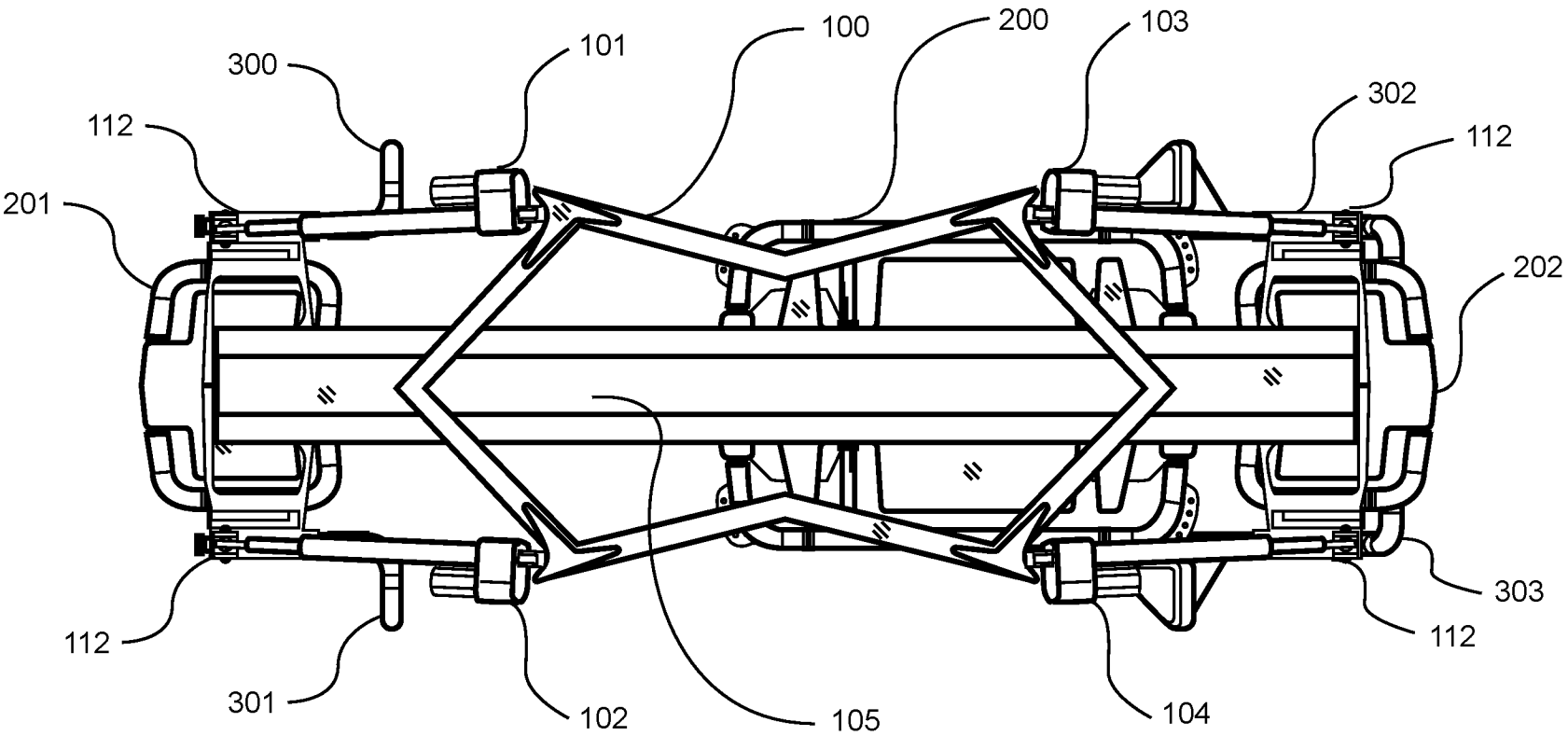
FIG. 5 is an exemplary diagram showing a bottom view of an improved exercise machine in accordance with an example embodiment.

FIG. 5 is an exemplary diagram showing a bottom view of an improved exercise machine 600. In the embodiment shown, one end of each of four actuators 101, 102, 103, 104 are rotatably attached to a base 100, and the opposed ends of the actuators 101, 102, 103, 104 are rotatably affixed to actuator mounting members 112 affixed to the exercise machine 600. A pair of platforms 201, 202 are affixed to substantially opposed ends of the exercise machine 600. The back right and left handle assemblies 300, 301 may be affixed to their respective sides of the first platform 201, and a front right and left handle assembly 302, 303 are affixed to their respective sides of the second platform 202. A movable carriage 200 may be slidably affixed to the exercise machine 600, and slides reciprocally substantially the length of the exercise machine 600 between the platforms 201, 202.

In an exemplary embodiment, the actuators 101, 102, 103, 104 may be the only supporting members extending between the base 100 and the exercise machine 600. The manner in which the actuators 101, 102, 103, 104 are connected between the base 100 and the exercise machine 600 may vary in different embodiments. Further, the size, shape, orientation, and positioning of the actuators 101, 102, 103, 104 may vary in different embodiments.

An exemplary arrangement of actuators 101, 102, 103, 104 is shown in FIG. 4. As shown, a first actuator 101 extends between a first end of the base 100 and a first end of the exercise machine 600. A second actuator 103 extends between a second end of the base 100 and a second end of the exercise machine 600. A third actuator 102 extends between a first end of the base 100 and a first end of the exercise machine 600. A fourth actuator 104 extends between a second end of the base 100 and a second end of the exercise machine 600. It should be appreciated that this is merely an exemplary embodiment, and other positioning may be utilized.

In the exemplary embodiment shown in the figures, the first and third actuators 101, 102 each extend from different points on the first end of the base 100. The second and fourth actuators 103, 104 extend from different points on the second end of the base 100. The manner in which the actuators 101, 102, 103, 104 are connected to the base 100 may vary, including the use of articulating connectors 113 as described herein.

The actuators 101, 102, 103, 104 may adjust in orientation as they extend and/or retract; such as by rotating or pivoting about the articulating connectors 113 as shown in the exemplary figures. The actuators 101, 102, 103, 104 may be connected to both the base 100 and the exercise machine 600 by articulating connectors 113 to allow maneuverability of the actuators 101, 102, 103, 104 on both their proximal and distal ends when extending or retracting. In other embodiments, only one end (distal or proximal) of the actuators 101, 102, 103, 104 may be connected by an articulating connector 113; with the opposing end being connected by another linkage such as a clasp, bracket, or hinge.

In the exemplary embodiment shown in the figures, the first and third actuators 101, 102 are connected at their distal ends to the exercise machine 600. The position on the exercise machine 600 to which the distal ends of the first and third actuators 101, 102 are connected may vary in different embodiments. The distal ends of the first and third actuators 101, 102 may be connected to a position at or near the first end of the exercise machine 600. In the exemplary figures, the first and third actuators 101, 102 are connected to the first platform 201 of the exercise machine 600. The first and third actuators 101, 102 may be parallel with respect to each other or may extend at different angles.

In the exemplary embodiment shown in the figures, the second and fourth actuators 103, 104 are connected at their distal ends to the exercise machine 600. The position on the exercise machine 600 to which the distal ends of the second and fourth actuators 103, 104 are connected may vary in different embodiments. The distal ends of the second and fourth actuators 103, 104 may be connected to a position at or near the second end of the exercise machine 600. In the exemplary figures, the second and fourth actuators 103, 104 are connected to the second platform 202 of the exercise machine 600. The second and fourth actuators 103, 104 may be parallel with respect to each other or may extend at different angles.

Figure 6:
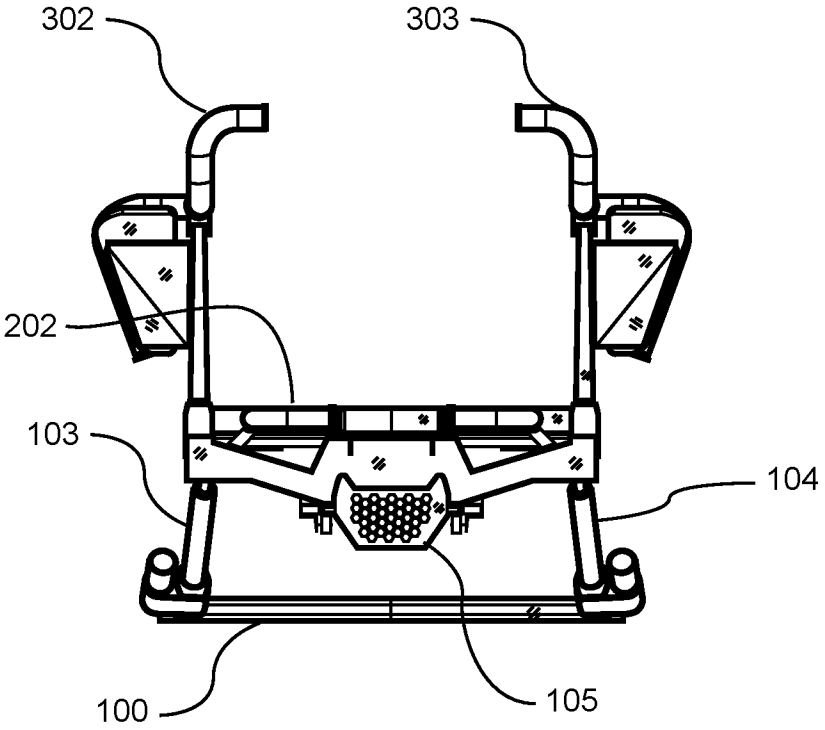
FIG. 6 is an exemplary diagram showing front end view of an improved exercise machine in accordance with an example embodiment.

FIG. 6 is an exemplary diagram showing a front end view of an improved exercise machine 600. The exercise machine 600 may include a second platform 202 and a front right and left handle assembly 302, 303 affixed to a track 105. The track 105, platforms 201, 202, and the front right and left handle assemblies 302, 303 may be supported above a base 100 by linear actuators 101, 102, 103, 104.

Figure 7:
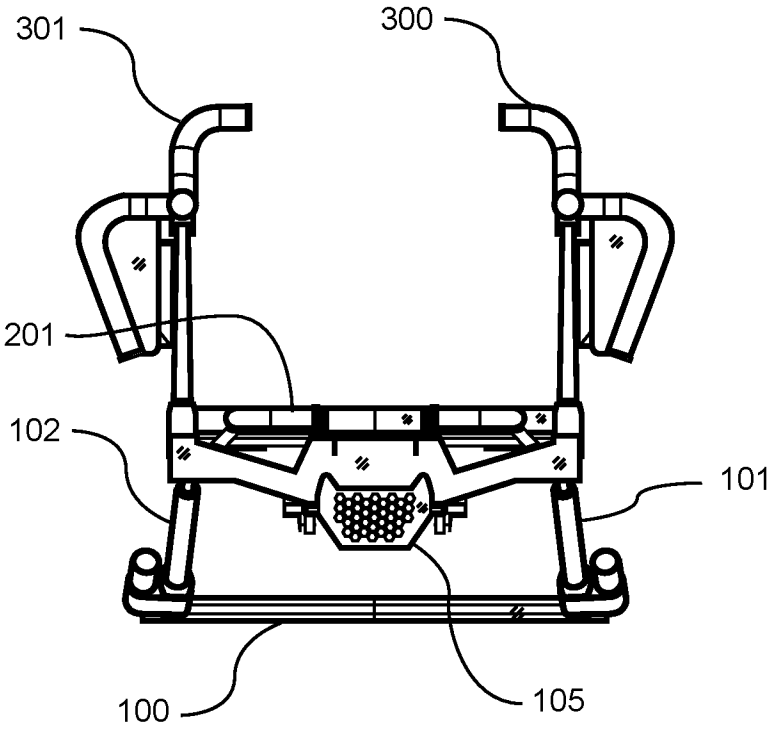
FIG. 7 is an exemplary diagram showing back end view of an improved exercise machine in accordance with an example embodiment.

FIG. 7 is an exemplary diagram showing back end view of an improved exercise machine 600. The drawing shows an first platform 201 and a back right and left handle assembly 300, 301 affixed to a track 105. The track 105, platforms 201, 201, and the back right and left handle assemblies 300, 301 may be supported above a base support structure 100 by linear actuators 101, 102, 103, 104.

Figure 8:
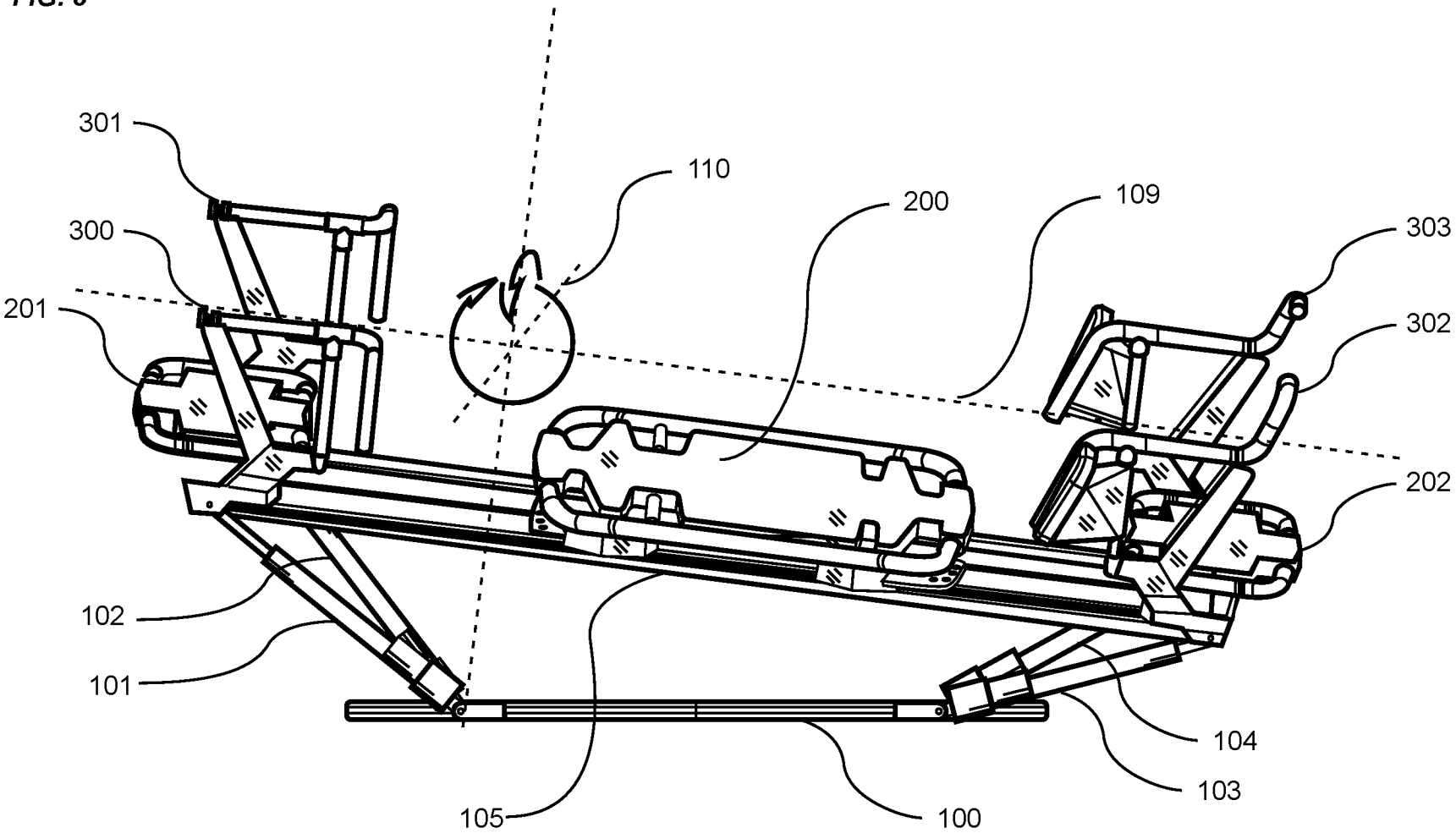
FIG. 8 is an exemplary diagram showing side end view of tilted and rotated exercise machine in accordance with an example embodiment.

FIG. 8 is an exemplary diagram showing a side end view of tilted and rotated exercise machine 600. It is sometimes preferable to position an exercise machine 600 along a non-horizontal plane (such as a diagonal plane) to overcome muscle memory, and to stimulate muscles that would otherwise not be engaged during an exercise performed on a horizontal plane.

In FIG. 8, it can be readily seen that the first platform 201 and the back right and left handle assemblies 300, 301 have been rotated about the transverse axis 110 to a higher vertical elevation relative to the second platform 202 and front right and left handle assemblies 302, 303 by extending the first and third actuators 101, 102 to a length that exceeds the length of the second and fourth actuators 103, 104; the actuators just described being rotatably affixed to the base 100.

In the non-horizontal orientation as shown in FIG. 8, a movable carriage 200 slidably attached to the exercise machine 600 will reciprocally slide substantially between the first platform 201 and second platform 202, sliding up an incline as it moves towards the first platform 201, and declining as it moves toward the second platform 202. A resistance force against the movable carriage 200 is created by removably attaching one or more biasing members 106 between the movable carriage 200 and, in some embodiments, the exercise machine 600 structure proximate to the second platform 202.

Further, as shown in the drawing, the exercise machine 600 may be rotated about the longitudinal axis indicated 109 of the track 105 by extending the third actuator 102 to a length that exceeds the length of the first actuator 101, and correspondingly extending the fourth actuator 104 to a length that exceeds the length of the second actuator 103.

Those skilled in the art will appreciate that coordination between the actuation of all actuators 101, 102, 103, 104 may be beneficial to prevent tension, compression or torsional stresses to be introduced to the exercise machine 600. Coordination of the simultaneous actuation of the actuators 101, 102, 103, 104 may be preferably managed by a computer program or programmable controller 500.

Figure 9A:
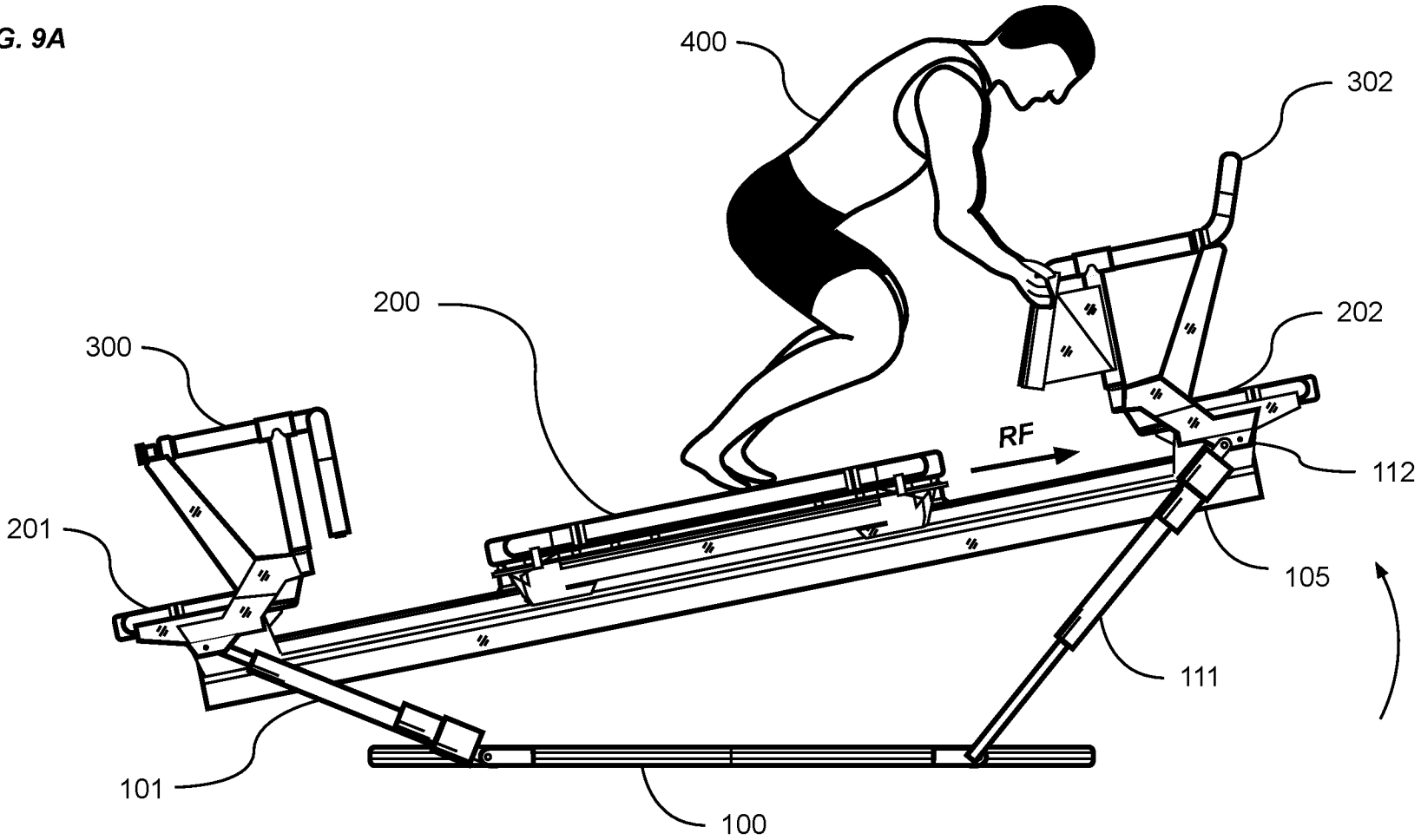
FIG. 9A is an exemplary diagram showing a right side view of an inclined exercise machine and an exerciser in accordance with an example embodiment.

FIG. 9A is an exemplary diagram showing a right side view of an inclined exercise machine 600 supported above a base 100 by a plurality of actuators 101, 102, 103, 104, and an exerciser 400. Although first actuator 101 and first inverted actuator 111 are shown, a second back and front actuator are obscured by the proximate actuators because the pair of back, and pair of front actuators are similarly positioned.

In FIG. 9A, it can be readily seen that the second platform 202 and front handle assembly 302 have been raised in the direction of the arched line and arrow head by extending the second actuator 103 and first actuator 101, while at the same time, the first platform 201 and handle assembly 300 have been lowered relative to the front of the exercise machine 600 by means of retracting the first actuator 101 and second actuator 103.

An exerciser 400 is shown standing on the inclined movable carriage 200 while gripping the front right handle assembly 302 and front left handle assembly 303. A movable carriage 200 is slidable along substantially the length of the exercise machine 600; the carriage 200 being resistance-biased towards the front end of the machine 600 by one or more biasing members 106. In practice, the exerciser 400 would perform the instant exercise by extending his legs and pushing his arms forward to move the slidable carriage 200 down the incline in a direction opposed to the resistance force RF created by the one or more biasing members 106.

It should be noted that the method of installing an actuator 101, 102, 103, 104 between the base 100 and exercise machine 600 is not meant to be limiting. In the embodiment shown in FIG. 9A, the front inverted actuator 111 is shown with the distal end of the first extensible/retractable portion affixed to the base support structure 100, and the second portion affixed to the actuator mounting member 112 of the exercise machine 600.

Figure 9B:
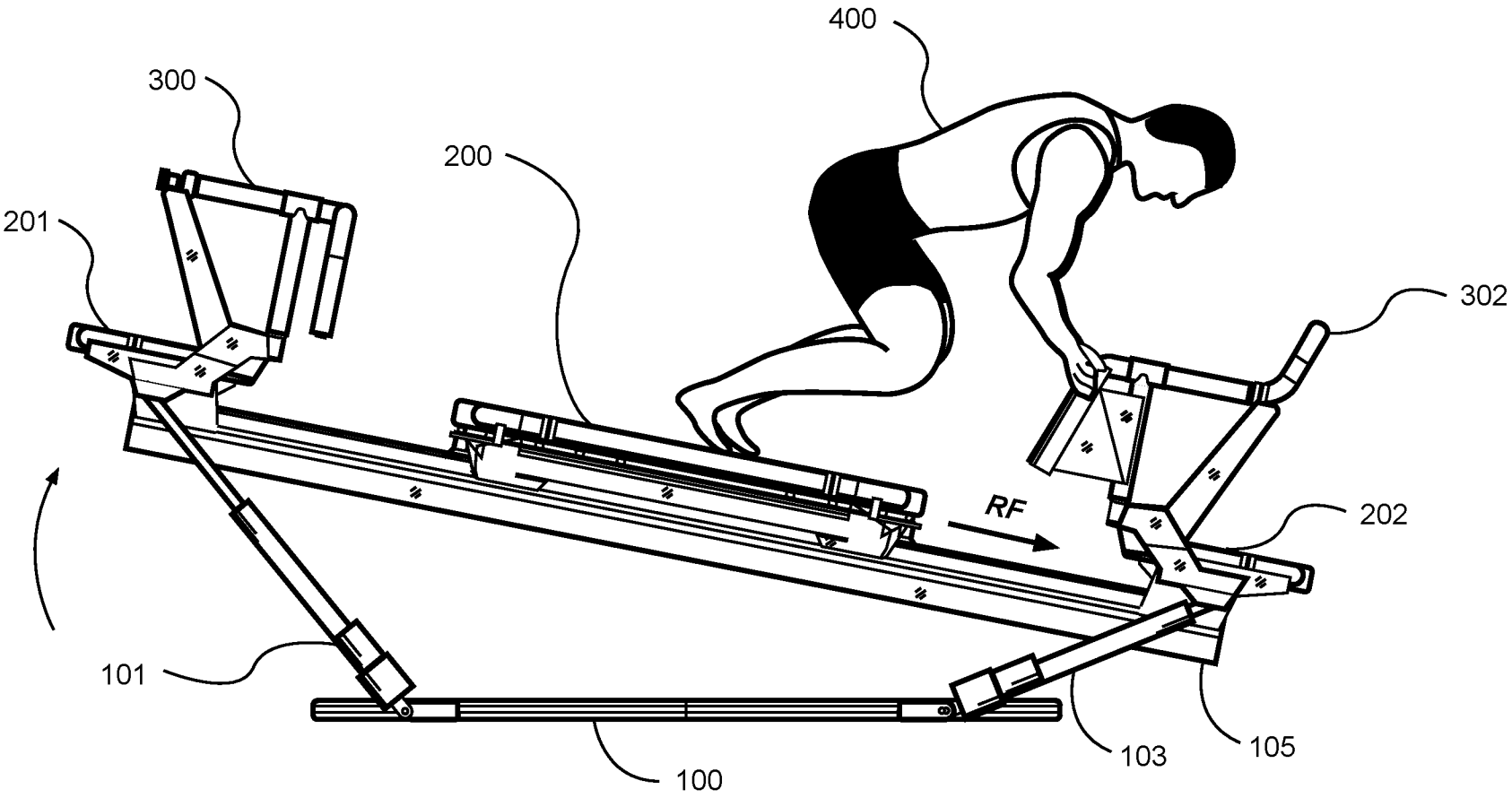
FIG. 9B is an exemplary diagram showing a right side view of a declined exercise machine and an exerciser in accordance with an example embodiment.

FIG. 9B is an exemplary diagram showing a right side view of a declined exercise machine 600 and an exerciser 400. In FIG. 9B, it can be readily seen that the second platform 202 and front handle assembly 302 have been lowered by retracting the second actuator 103 and first actuator 101, while at the same time, the first platform 201 and handle assembly 300 have been raised relative to the front of the exercise machine 600 in the direction of the arched line and arrow head by means of extending the first actuator 101 and second actuator 102.

Figure 10:
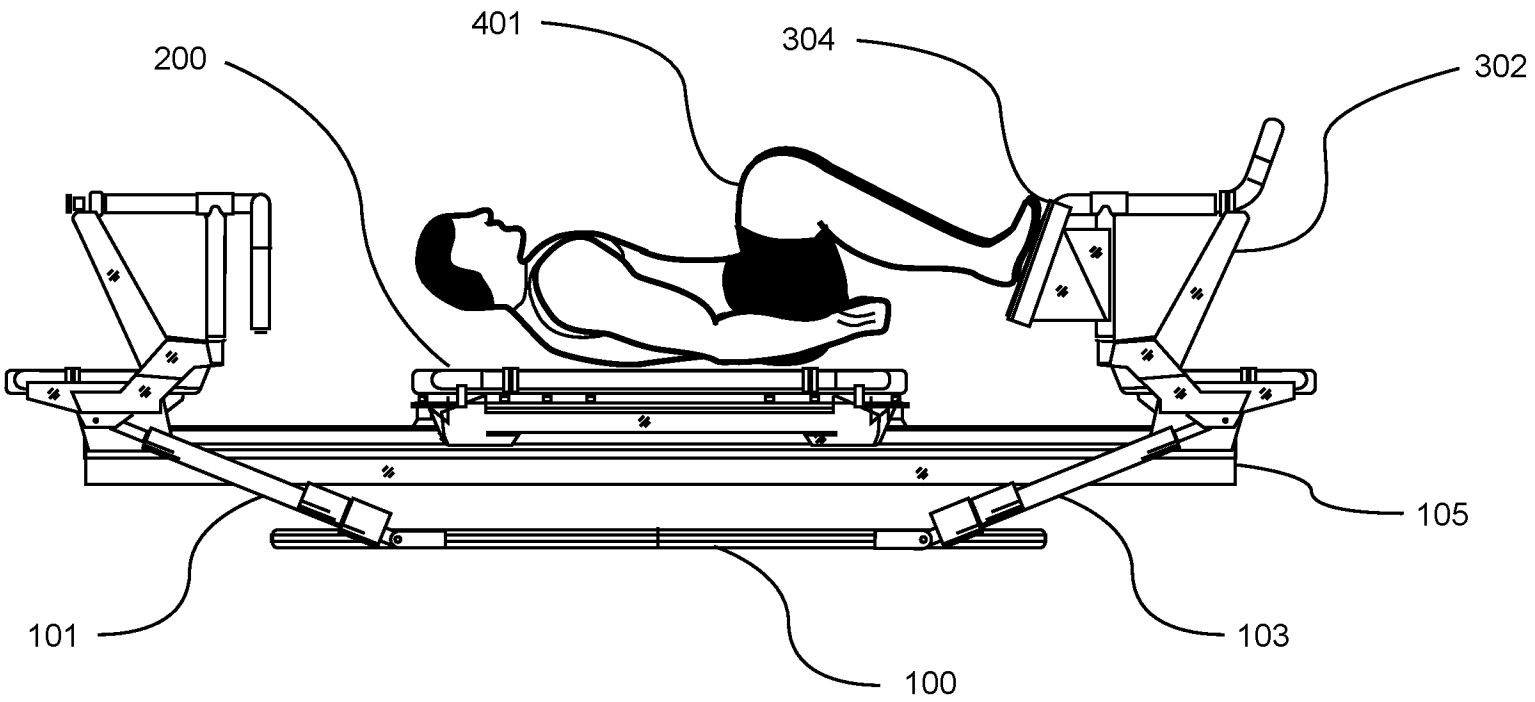
FIG. 10 is an exemplary diagram showing a right side view of a horizontally positioned exercise machine platform and an exerciser in accordance with an example embodiment.

FIG. 10 is an exemplary diagram showing a right side view of a horizontally positioned exercise machine 600 and an exerciser 401. In some instances, it is desirable to exercise the leg muscles. In the drawing, an exerciser 401 is supine upon the movable carriage 200 with his feet placed upon the right push pad 304 and left push pad 305. The right push pad 304 is affixed to the right handle assembly 302. The left push pad 305 and left handle assembly 301 are not shown in FIG. 10 because they are obscured by the right push pad 304 and right handle assembly 300, but they are mirror image versions of the right push pad 304 and handle assembly 300.

The longitudinal track 105, and correspondingly the movable carriage 200 are shown aligned substantially horizontally and parallel to the base 100. The actuators 101, 102, 103, 104 are all extended to predetermined lengths that cause the exercise platforms 201, 202 to be aligned substantially horizontally.

Figure 11B:
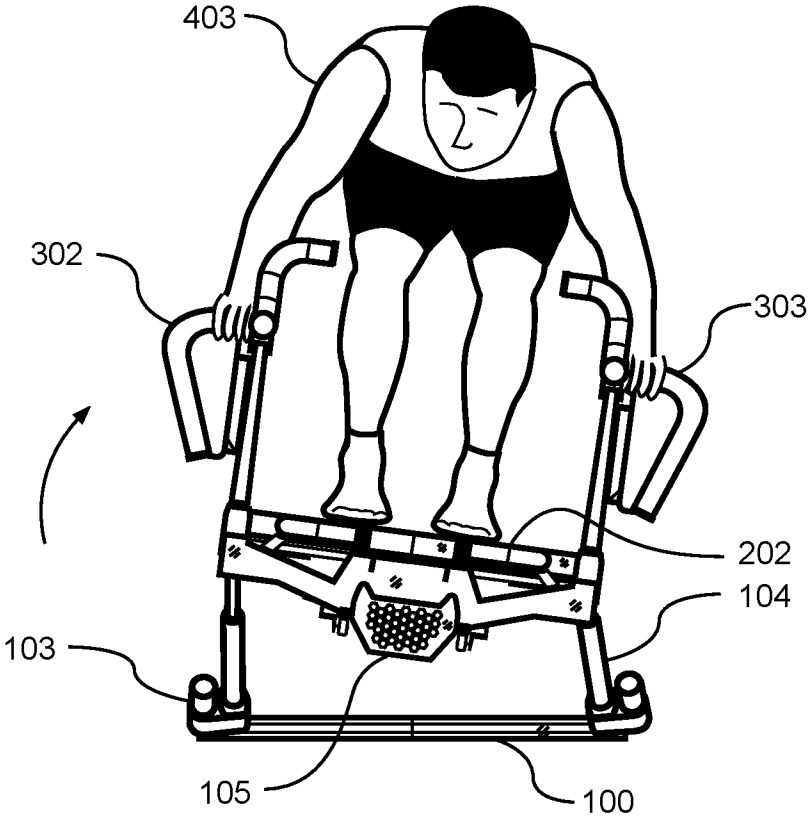
FIG. 11B is an exemplary diagram showing front end view of a left rotated exercise machine and an exerciser in accordance with an example embodiment.
Figure 11A:
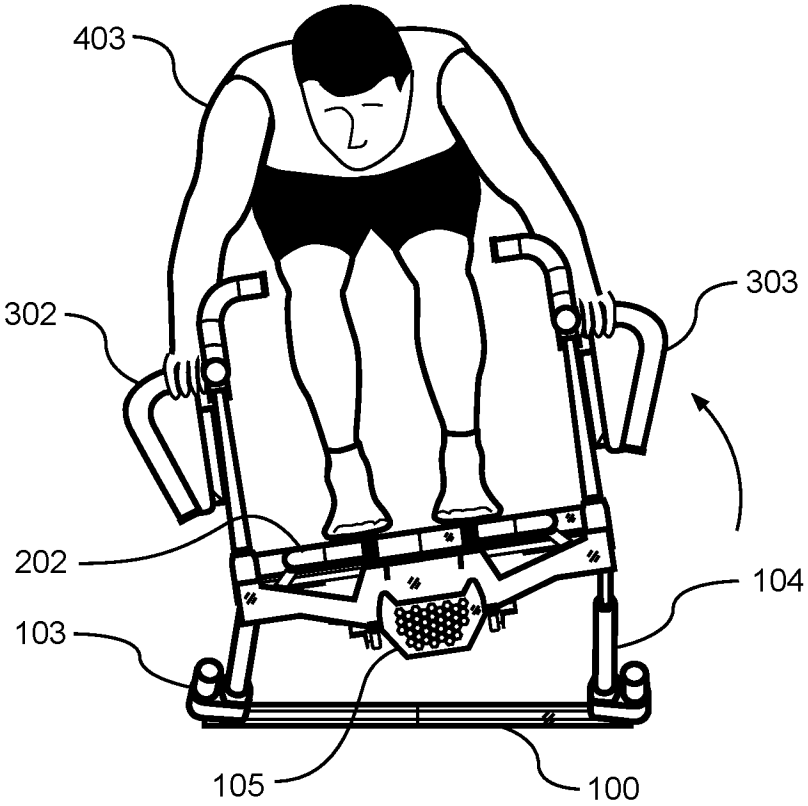
FIG. 11A is an exemplary diagram showing front end view of a right rotated exercise machine and an exerciser in accordance with an example embodiment.

FIG. 11A is an exemplary diagram showing front end view of a right rotated exercise machine and an exerciser. In the drawing, an exerciser 403 is shown standing on the movable carriage assembly not shown because it is obscured by the front stationary platform assembly 202. Leaning forward, the exerciser 403 stabilizes himself by gripping the front right and front left handle assemblies 302, 303.

As previously described, changing the angle of the exercise plane before or during exercising provides for avoiding muscle memory. As can be readily seen, the exercise plane of the movable carriage 200 and second platform 202 is changed by rotating the track 105 about its central axis in the direction of the arched line and arrow head. The first and fourth actuators 101, 104 are extended while the second actuator 103 and third actuator 102 are not extended; thereby increasing the vertical dimension between the left side of the exercise machine 600 and the base 100 relative to the right side of the machine 600.

It should be noted that if the exercise machine 600 was previously elevated above the lower default starting position as previously described, the same or similar rotation of the track 105 about its central axis could be similarly achieved by maintaining the position of the fourth actuator 104 and third actuator 102, and retracting the second actuator 103 and first actuator 101 to lower the right side of the machine 600 relative to the left side of the machine 600.

FIG. 11B is an exemplary diagram showing front end view of a left rotated exercise machine 600 and an exerciser 403. In the embodiment of FIG. 11B, the exercise plane of the movable carriage 200 and second platform 202 is changed by rotating the track 105 about its central axis in the direction of the arched line and arrow head by extending the first and second actuators 101, 103, and not actuating the third and fourth actuators 102, 104; thereby increasing the vertical dimension between the right side of the exercise machine 600 and the base 100 relative to the right side of the machine 600.

Figure 12C:
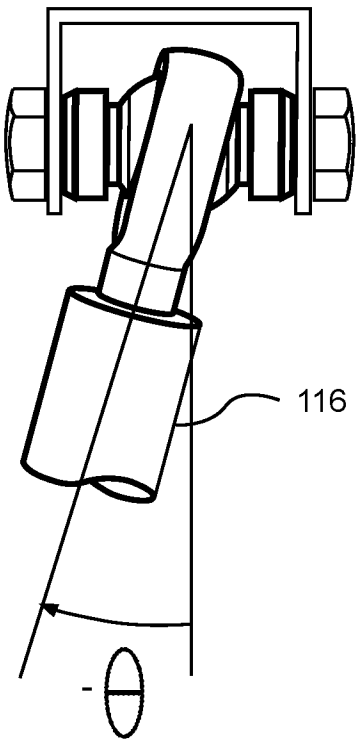
FIG. 12C is a frontal view of an articulating connector of an exercise machine in a second orientation in accordance with an example embodiment.
Figure 12B:
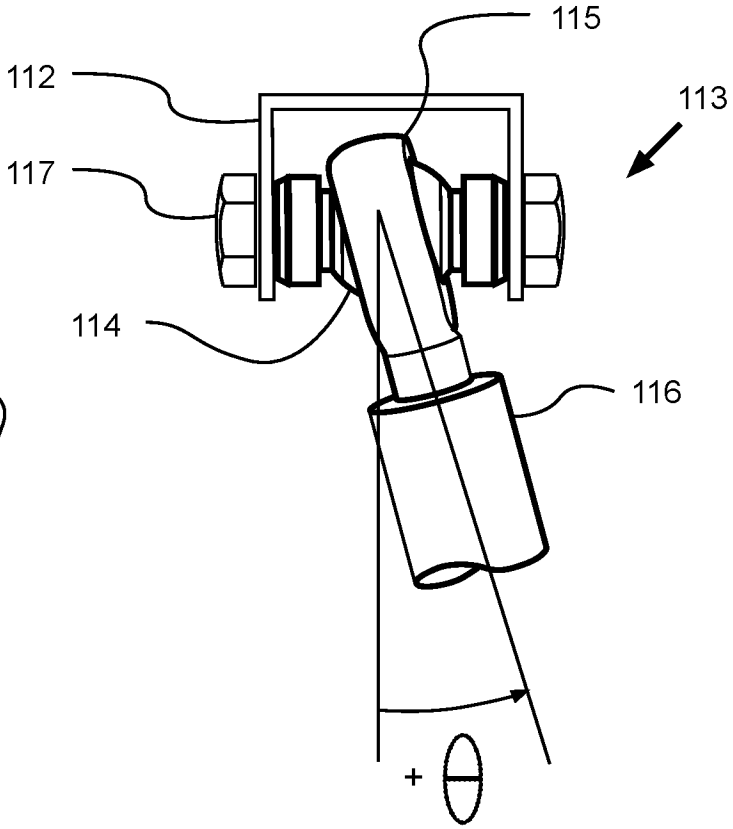
FIG. 12B is a frontal view of an articulating connector of an exercise machine in a first orientation in accordance with an example embodiment.
Figure 12A:
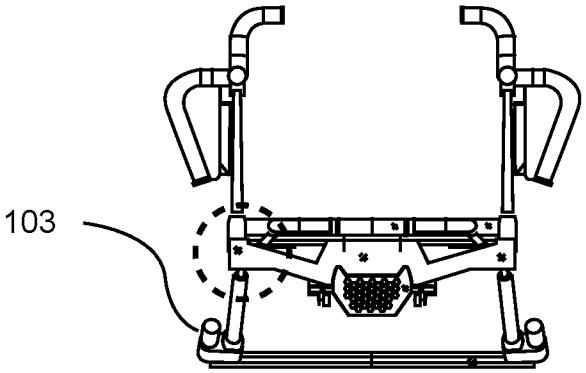
FIG. 12A is a frontal view of an exercise machine in accordance with an example embodiment.

FIG. 12A-C illustrate an articulating actuator connection. FIG. 12A illustrates an end view of an exercise machine 600 as previously described with a second actuator 103 being rotationally affixed to an actuator mounting member 112 positioned substantially as a corner of the exercise machine 600 as indicated by the dotted line circle. In FIGS. 12B and 12C, an articulating connector 113 such as a Heim joint is shown comprising an actuator mounting member 112 within which a bearing housing 115 and misalignment bearing 114 retained within the bearing housing 115 is positioned.

A bearing fastener 117 such as a bolt and nut or clevis pin may inserted through the mounting member 112 and the bore through the misalignment bearing 114. The articulating connector 113 may be affixed to the distal end 116 of the extensible/retractable portion of the actuator 101, 102, 103, 104. Although not shown in FIG. 12B, the opposed end of the second portion of the linear actuator 101, 102, 103, 104 is preferably affixed to the base support structure using a similar articulating connector 113.

In practice, the bearing housing 115 may be repositioned by rotating the actuator shaft 116 about the central axis of the bearing fastener 117. Further, the bearing housing 115 may be articulated about the bearing 114 to allow for the shaft 116 to be oriented other than substantially perpendicular to the central axis of the bearing fastener 177. As can be seen, the actuator shaft 116 may be misaligned to laterally or medially with respect to the position of the actuator mounting member 115 within an angular range indicated by the plus or minus theta angles shown on FIGS. 12B and 12C.

Figure 13A:
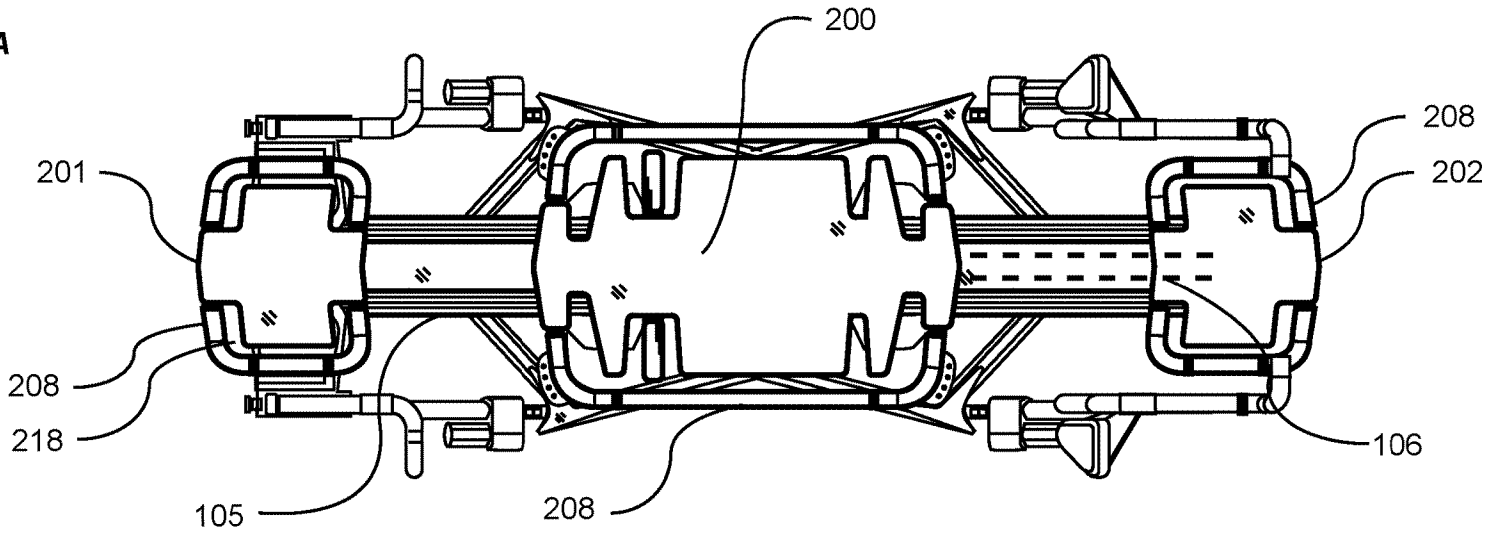
FIG. 13A is an exemplary diagram showing a top view of an improved exercise machine in accordance with an example embodiment.

FIG. 13A is an exemplary diagram showing a top view of an improved exercise machine 600. More specifically, one variation of an improved exercise machine provides for a second platform 202, a first platform 201, and a movable carriage 200 with integral outboard round handles 208 with central axis of a portion of the handle that is substantially aligned with the central longitudinal axis of the track 105, and portions at the distal ends of the handles 208, 211 that are substantially aligned with the transverse axis of the exercise machine 600; the opposed distal ends being affixed to the platforms 201, 202. The round handles 300, 301 on the left side of the machine 600 are preferably mirror image versions of the round handles 302, 303 on the right side of the machine.

The round cross section profile of the handles 208, 211 may provide for easy and cost-effective manufacturing, while also providing for a comfortable natural grip by the exerciser's 403 hands.

As previously discussed, in practice, one or more biasing members 106 may be removably attached between the movable carriage 200 and the exercise machine 600 structure substantially at a front end of the machine 600. The exercise force required to move the movable carriage 200 in a direction opposed to the end of the machine 600 to which the biasing members 106 are attached must be sufficient to overcome the resistance force of the biasing members 106. The resistance force may be increased or decreased by attaching or detaching additional biasing members 106.

Figure 13B:
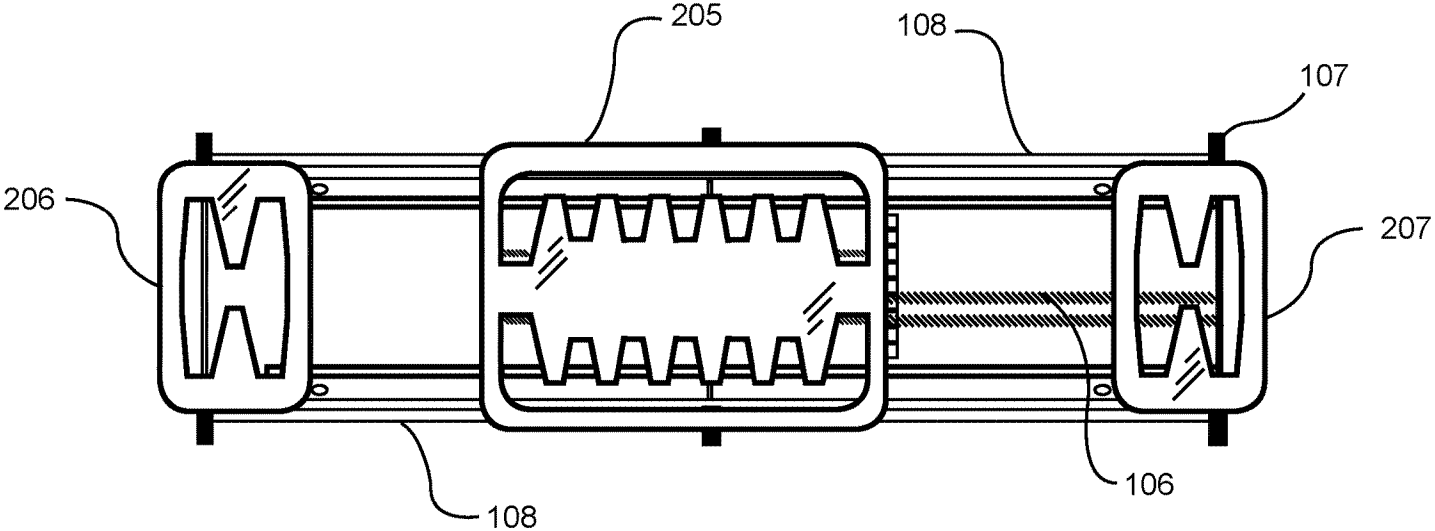
FIG. 13B is an exemplary diagram showing a top view of a variation of an exercise machine in accordance with an example embodiment.

FIG. 13B is an exemplary diagram showing a top view of a variation of an exercise machine 600. In a more traditional configuration, an exercise machine 600 is comprised of a plurality of supporting feet 107 extending between the floor surface and a machine 600 structure; a machine structure 600 comprising two parallel longitudinal rails 108, a pair of platforms 206, 207, and a movable carriage 205 slidable upon the parallel rails 108 substantially the length of the rails 108 between the platforms 206, 207. Biasing members 106 removably attached between the movable carriage 200 and the machine 600 structure provide for variable exercise resistance as previously described.

One variation of the exercise platforms 206, 207 provides for openings within the platform 206, 207; thereby creating additional lateral projections within the perimeter of the platforms 206, 207 used by the exerciser 403 for gripping or pushing against during exercise.

Figure 14A:
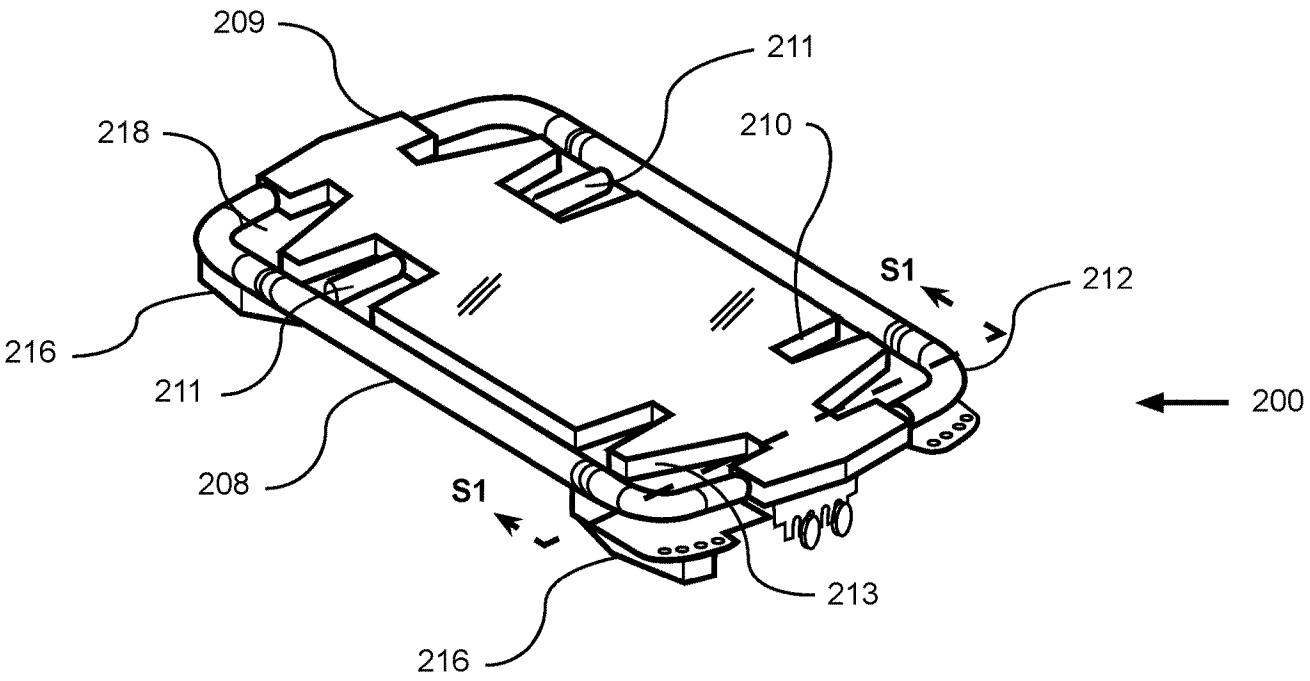
FIG. 14A is an exemplary diagram showing an isometric view of a movable carriage assembly of an improved exercise machine in accordance with an example embodiment.

FIG. 14A is an exemplary diagram showing an isometric view of a movable carriage 200 of an improved exercise machine 600 comprising a platform center pad 209 extending substantially the length of the carriage 200, a plurality of trolley wheel assemblies 216 that engage with the parallel rails 108 of the track 105 as previously described, and a left and right outboard round handle 208 providing for hand gripping surfaces on the lateral portions of the carriage 200, and handle corners 212 providing for gripping surfaces on the opposed corners on the front and back portions of the carriage 200.

The platform center pad 209 is typically comprised of an internal structure that is covered with a resilient material of nominal thickness providing for comfortable kneeling, sitting or standing on by an exerciser 403.

In FIG. 14A, the opposed ends of the exercise pad 209 extend substantially the length of the carriage 200, while the lateral edges of the pad 209 are formed with a geometry that creates voids 218 between the pad 209 and outboard round handles 208, and at the same time creates lateral projections 213 that provide for additional gripping or pushing surfaces of the carriage. In some instances, the void may comprise a pad slot 210 into which a hand or foot may be inserted for gripping, pushing or pulling. Further, the present invention may provide for affixing a pair of inboard round handles 211 that provide a more stable and solid gripping surfaces within the perimeter of the carriage 200.

Figure 14B:
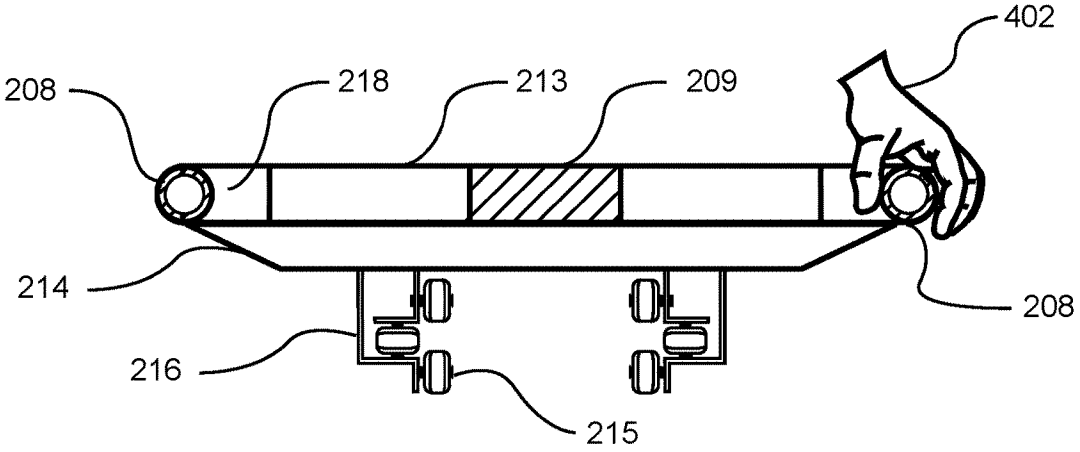
FIG. 14B is an exemplary diagram showing section view through a movable carriage assembly of an improved exercise machine in accordance with an example embodiment.

FIG. 14B is an exemplary diagram showing section view through a movable carriage 200 of an improved exercise machine 600. More specifically, a view through section S1 of FIG. 14A cut through a movable carriage 200 is shown comprising a platform center pad 209 of a nominal thickness to provide cushioning for an exerciser 403, a lateral projection 213 of the pad 209 to provide for a gripping or pushing surface, an outboard round handle 208 positioned along the lateral perimeter of the carriage 200, and a pad void 218 formed between the pad 209 and outboard round handle 208.

A platform 214 provides for the mounting of the pad 209 and outboard round bar 208 to the carriage 200, and further provides for the attachment of a plurality of trolley wheel assemblies 216 into which a plurality of trolley wheels 215 may be installed. The trolley wheels 215 and wheel supporting members are positioned substantially equal lateral dimensions from the central axis of the machine 600 so that the wheels 215 engage parallel rails 108 affixed to the track 105. The trolley wheels 215 provide for retaining the carriage 200 to the track 105 while allowing the carriage 200 to roll substantially between the platforms 201, 202 along the parallel rails 108.

As can be seen, the outboard round handle 208 provides for a more comfortable and surer grip by an exerciser's hand 402 when compared to the substantially vertical surfaces and right-angle corner of the platform center pad 209, even if the right angle edge is rounded to minimize sharp corners. Those skilled in the art will immediately appreciate the advantages of a round bar handle over a substantially rectilinear cross section of a resilient exercise pad when used as a hand gripping surface.

Figure 15A:
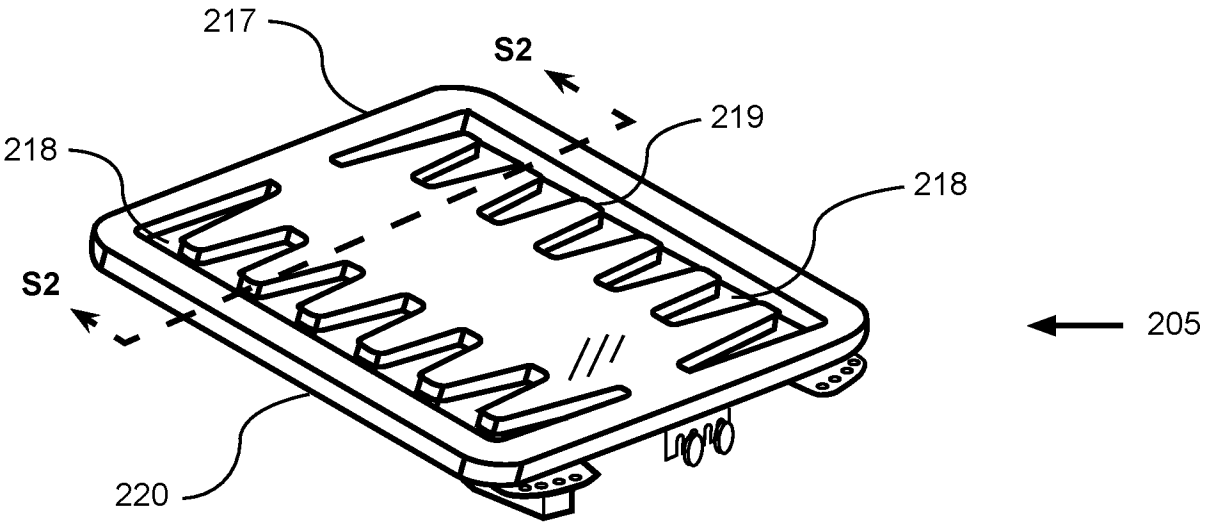
FIG. 15A is an exemplary diagram showing an isometric view of a variation of a movable carriage assembly in accordance with an example embodiment.

FIG. 15A is an exemplary diagram showing an isometric view of a variation of a movable carriage assembly variation 205. Manufacturing cost efficiencies sometimes drive certain design features that are acceptable to the exerciser 400. In the drawing, a carriage pad 217 may be produced as a single finished piece using well known thermoforming processes. A pad is produced with certain areas void 218 of pad material, thereby providing for penetrations through the carriage pad that create laterally projecting handles 219 and a perimeter 220 section that can be used as a handle, the perimeter handle extending substantially the length of the carriage pad.

Figure 15B:
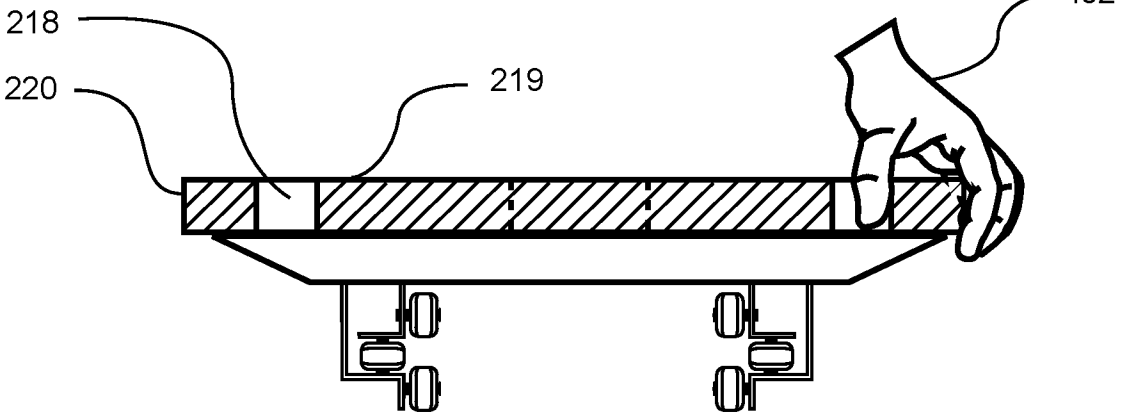
FIG. 15B is an exemplary diagram showing section view through a variation of a movable carriage assembly in accordance with an example embodiment.

FIG. 15B is an exemplary diagram showing section view through a variation of a movable carriage assembly. A view through section S2 of FIG. 15A cut through a movable carriage 200 is shown comprising a carriage pad 217 of a nominal thickness to provide cushioning for an exerciser 400, a laterally projecting handle 219 of the pad 217 providing for a gripping or pushing surface substantially aligned at an obtuse angle relative to the central longitudinal axis of an exercise machine 600, and a pad perimeter 220 section that provides for a gripping handle with a central axis substantially aligned with the central longitudinal axis of an exercise machine 600. It should be noted that in some embodiments, the geometry of the pad 217 on one side of the centerline may be substantially a mirror image variation of the opposed side of the pad 217.

As can be readily seen, the thumb of a hand 402 may be comfortably inserted through the pad void 218 between the pad perimeter 220 and the laterally projecting handle 219, thereby providing for a cross sectional portion of the pad 217 dimensionally appropriate for use as a handle 219.

Figure 16:
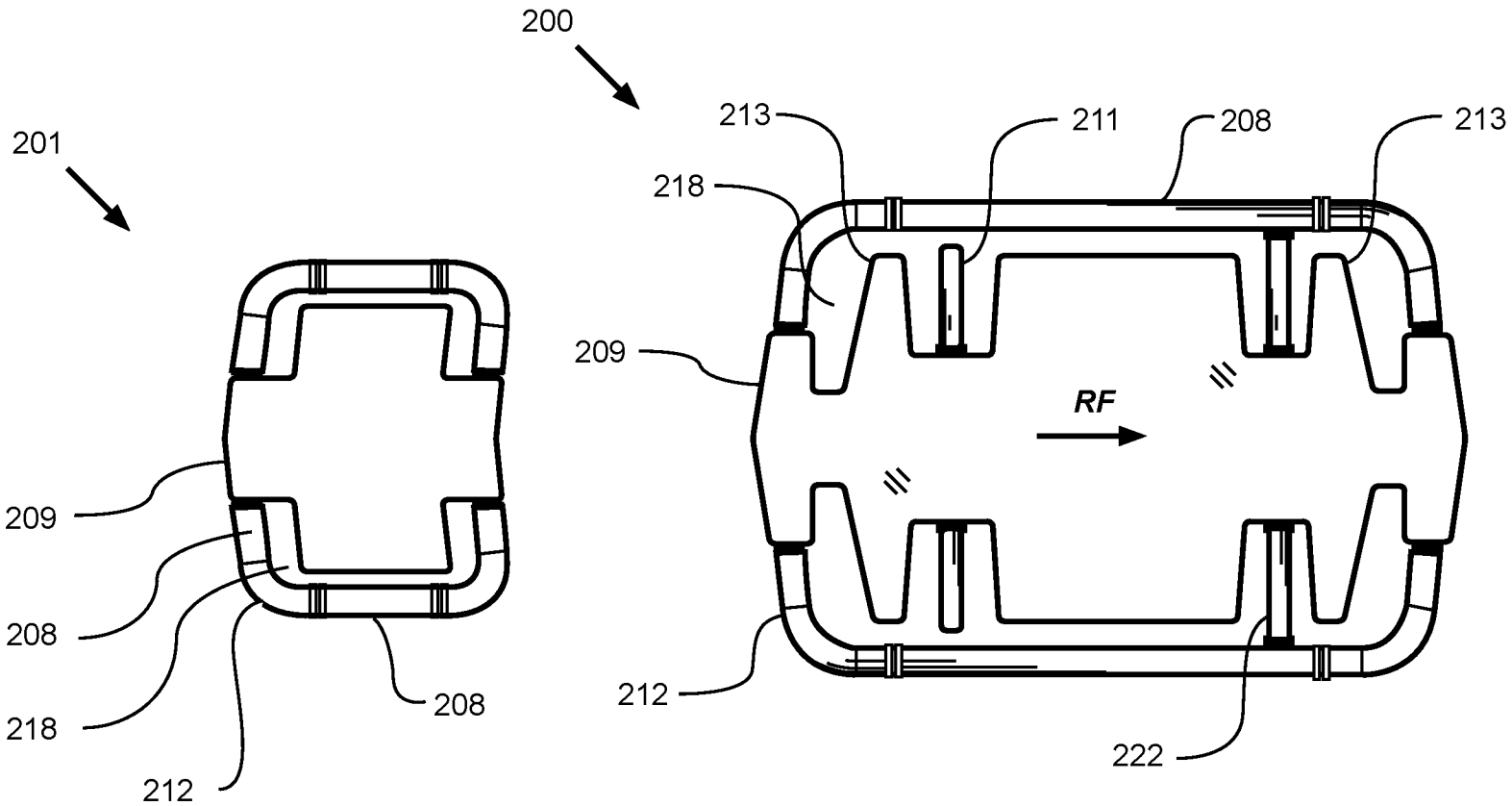
FIG. 16 is an exemplary diagram showing a top view of a movable carriage and stationary end platform in accordance with an example embodiment.

FIG. 16 is an exemplary diagram showing a top view of a movable carriage 200 and a first platform 201, each being substantially comprised of a platform center pad 209, two outboard round handles 208 positioned on the opposed lateral sides of the carriage 200; the opposed ends of the outboard round handles 208 being affixed to handle corners 212 and the handle corners further being affixed to the platform center pad 209. It should be noted that a second platform 202 may be substantially a mirror image of the first platform 201.

It should be noted that although not shown, various structural members may be used on the underside of the platform center pad 209, outboard round handles 208, handle corners 212, and the connection points between the pad 209, corner handles 212 and outboard handles 208 using well-known devices and/or methods. It is not the intention to limit the method of affixing the pad 209 and handles 208 to the structure of a movable carriage 200.

The geometry of the platform center pad 209 of the movable carriage 200 provides for a void 218 to be formed between the opposed perimeter edges of the pad and the perimeter outboard round handle 208 and handle corners 213. Further, the geometry results in the creation of a plurality of lateral projections 213 that may be used as gripping or pushing surfaces for an exerciser's hands or feet.

As previously described, in practice, a force is applied by an exerciser 400 to a movable carriage 200 to overcome a resistance force RF created by one or more biasing members 106 but removably attachable between a stationary exercise machine 600 and a movable carriage 200; the exercise force vector being applied substantially aligned with the central longitudinal axis of the exercise machine 600. Those skilled in the art will therefore appreciate that the central axis of an efficient handle used to push or pull a movable carriage 200 along the longitudinal axis of the machine 600 and against a resistance force would preferably be oriented substantially perpendicular to the central axis of the exercise machine 600 and biasing members 106.

In FIG. 16, a pair of inboard round handles 211 are illustrated as being affixed to the platform center pad 209 of the movable platform 200 with the distal ends of each handle 211 projecting toward the outboard round handle 208. A void 218 remains between the outboard round handle 208 and the projecting distal ends of the inboard round handle 211 to allow an exerciser 400 to insert a hand 402 into the void 218 to easily grasp the outboard round handle 208.

It should be noted that the inboard round handles 211 may be positioned at any desired location along the length of the carriage 200, for instance, at a dimension that is half of the length between the front and back of the carriage 200, and that the position of the handles 211 as shown in the drawing are not meant to be limiting.

One variation of the inboard round handle 211 is a cross handle 222. Two opposed cross handles 222 are shown in FIG. 16 as affixed at their proximate ends to a platform center pad 209; with their distal ends affixed to an outboard round handle 208 or to a mounting member that supports the outboard round handle 208. A cross handle 222 affixed at both ends may withstand the application of higher pushing or pulling forces resulting from exercising against a larger force created by the biasing members 106. Further, a cross handle 222 may provide for increased handle length as may be desired when using the handle 222 as a foot push bar.

Further, the void 218 formed between the center pad of the first platform 201 and the two outboard round handles 208 and handle corners 212 positioned on the opposed lateral sides of the platform 201 provide for gripping surfaces substantially the perimeter of the platform 201.

Figure 17:
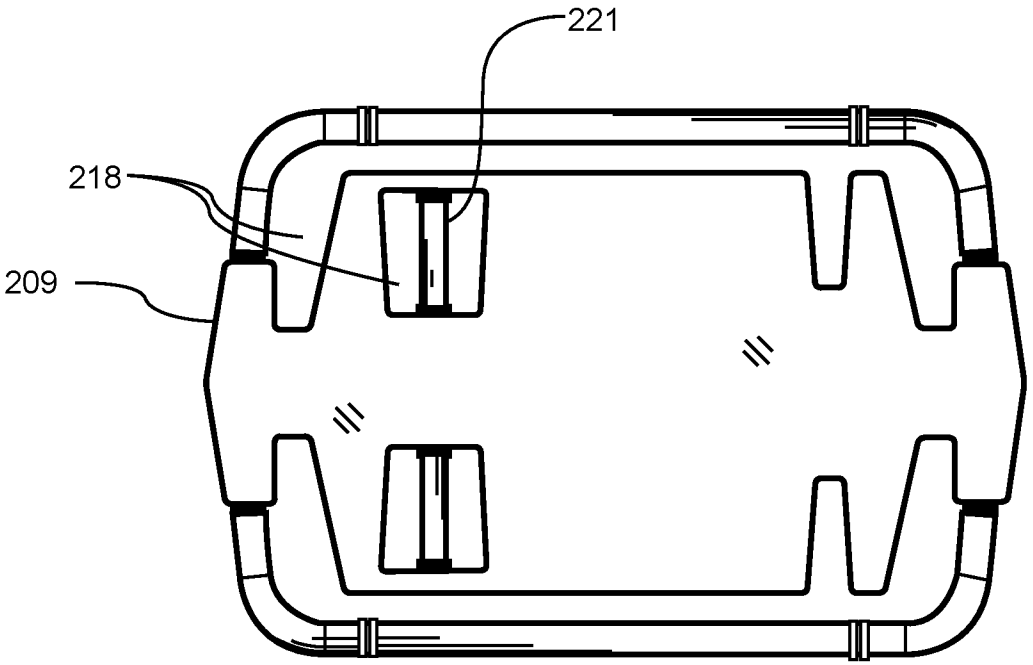
FIG. 17 is an exemplary diagram showing a top view of a variation of a movable carriage in accordance with an example embodiment.

FIG. 17 is an exemplary diagram showing a top view of a variation of a movable carriage 200 as just described. For certain exercises, it may be desirable to have one or more captive inboard handles 221 located at various positions within the platform center pad 209. In FIG. 17, it can be readily observed that each end of each handle 221 is affixed within a void 218 formed through the platform center pad 209; the central axis of the handles 221 being substantially perpendicular to the central axis of the carriage 200 and exercise machine 600. Although the drawing shows that the captive inboard handles 221 are positioned within a substantially rectangular void 218 through the platform center pad 209; the geometry of the void 218 is not limiting, and the handle 221 may be affixed for example within a circular void 218 through the platform center pad.

The dimension of the void 218 between the front and back surfaces of the captive inboard handle 221 may be be sufficient to accommodate the insertion of a hand 402 or foot of an exerciser 400 facing either the front or back of the carriage 200.

Figure 18:
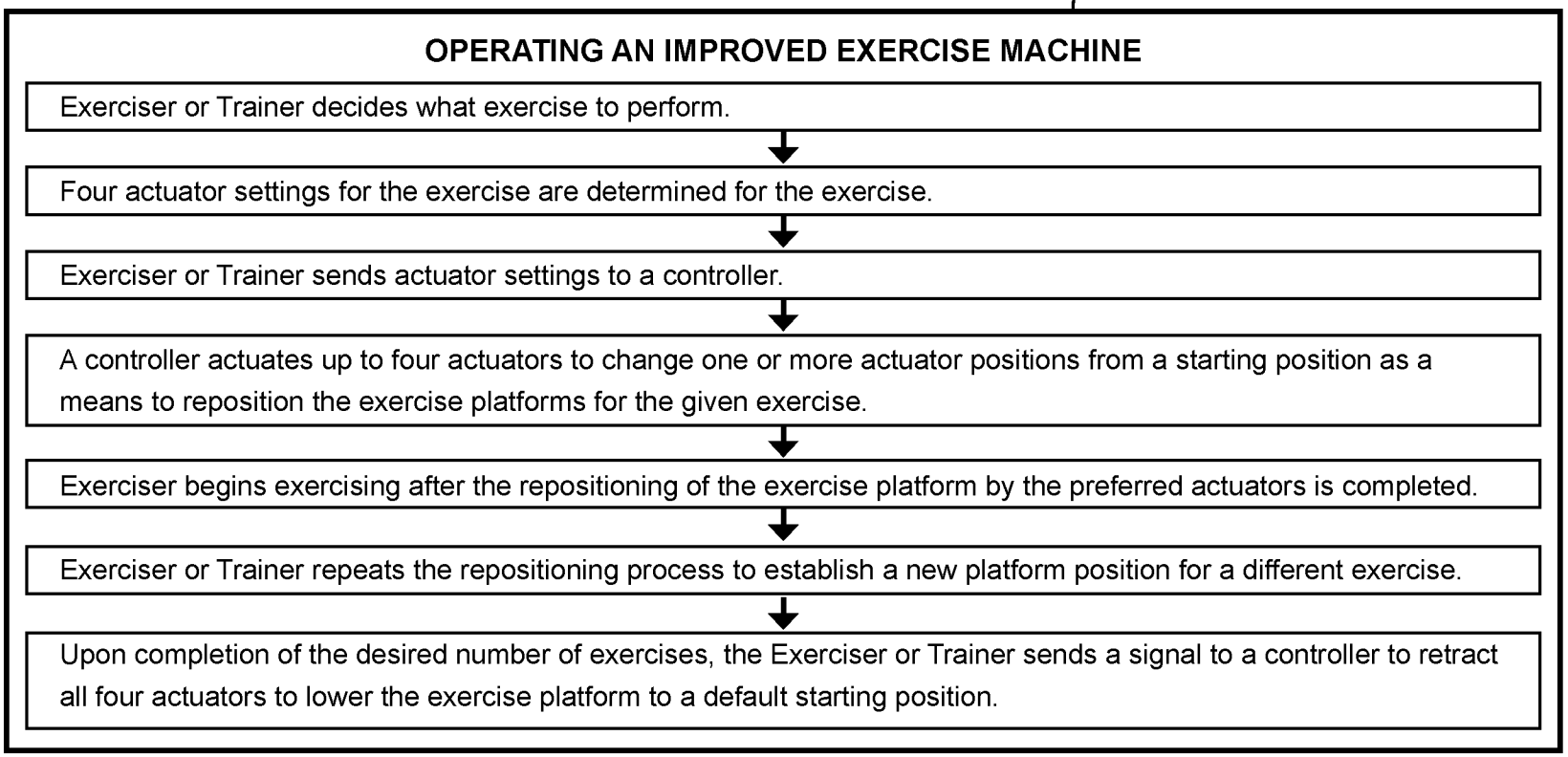
FIG. 18 is an exemplary illustration of a flow chart of an improved exercise machine in accordance with an example embodiment.

FIG. 18 is an exemplary illustration of a flow chart 507 listing one preferred sequence of starting up and operating an improved exercise machine 600. The steps shown in the drawing start with an exerciser 400 or trainer determining which exercise will be performed.

Based on the selected exercise, settings for the four actuators 101, 102, 103, 104 may be determined. The determination of the actuator 101, 102, 103, 104 positions may be preprogrammed, for example, into a controller 500 or software application, or may be determined ad hoc by the trainer or exerciser 400. The trainer or exerciser 400, in determining the actuator 101, 102, 103, 104 positions, sends communication to the controller 500 via a mobile device 502, or in one variation, by use an analog or digital signal inputting wired device 501 such as a joystick.

Having received the signal from the exerciser 400 or trainer via either a mobile device 502 or wired device 501, the controller 500 actuates the appropriate actuators 101, 102, 103, 104 by activating the actuator motors, or if using pneumatic or hydraulic actuators, by opening the appropriate valves to control fluid flow in communication with the preferred actuators 101, 102, 103, 104.

Upon the exercise platforms 201, 202 and/or carriage 200 reaching the desired plane, the exerciser 400 begins the exercise. After completing the given exercise on the instant position of the exercise platforms 201, 202 and/or carriage 200, the exerciser 400 or trainer determines the next exercise in the workout sequence, and repositions the exercise machine 600 by repeating the process just described.

When the last repetition of the last exercise is completed, the exerciser 400 or trainer sends a signal to the controller 500, such as by a wired device 501 or mobile device 502; the signal thereby directing all of the actuators 101, 102, 103, 104 to return to the lowest, fully retracted state that returns the exercise machine 600 to the lowest level, positioned on a substantially horizontal plane.

It should be noted that a trainer may elect to change the positioning of the exercise machine 600 during an exercise rather than waiting until all of the repetitions of a particular exercise are complete. The trainer may change the positioning of the exercise machine 600 during the performance of an exercise by repeating the steps just described.

Figure 19:
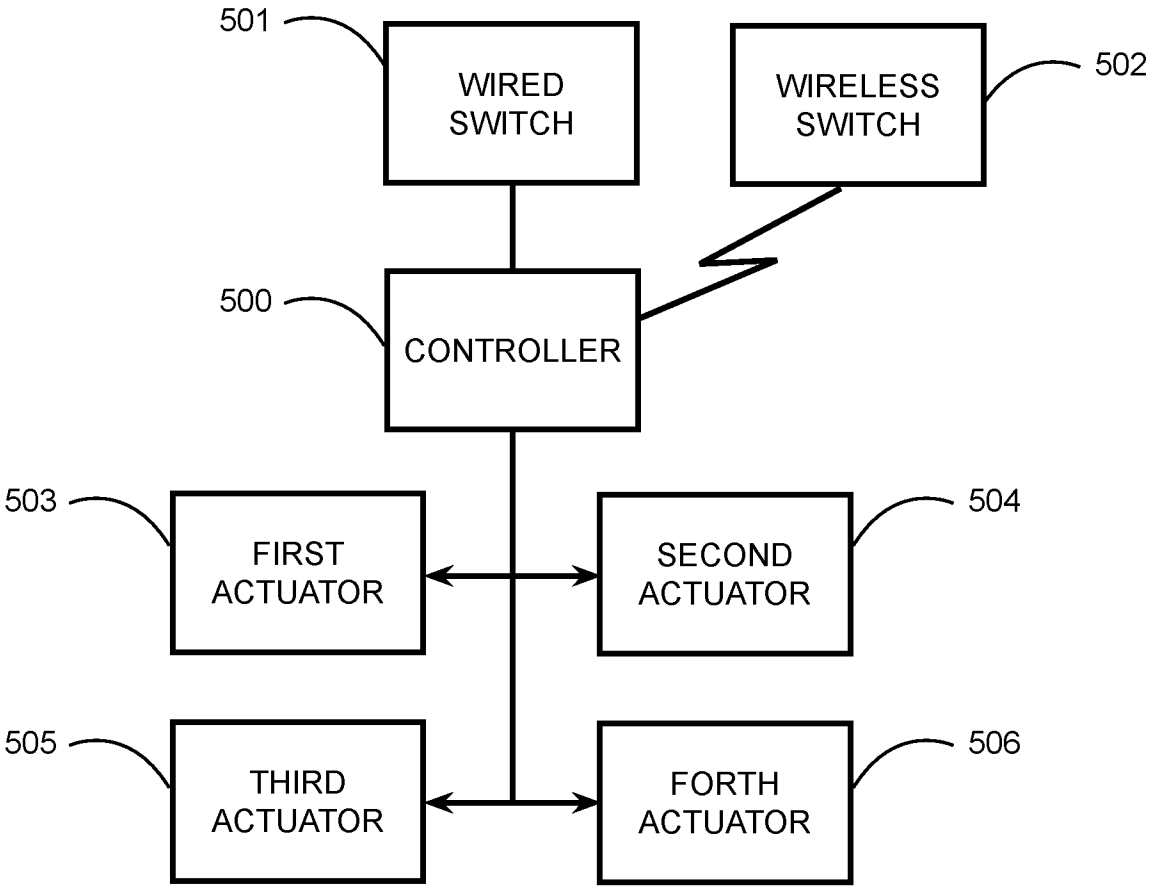
FIG. 19 is an exemplary illustration of a block diagram of one control means of an improved exercise machine in accordance with an example embodiment.

FIG. 19 is an exemplary illustration of a block diagram of one control method of an improved exercise machine. In order to minimize torsional, compressive or tensile stresses throughout the exercise machine 600 structure, at least two diagonally opposed actuators 101, 102, 103, 104 must be actuated in unison, one extending while the opposed actuator 101, 102, 103, 104 is retracting. In some cases, all four actuators 101, 102, 103, 104 will move in unison so that a new plane and/or elevation of the exercise machine 600 may be achieved. Therefore, an exemplary method of controlling the four actuators 101, 102, 103, 104 is by a software program that ensures that the preferred relative positions of each actuator 101, 102, 103, 104 to the others is maintained throughout the exercise machine 600 repositioning. Therefore, a program may be installed in a processor in communication with the controller 500, or on the transmitting device 501, 502.

In one variation, the program is installed on a controller 500. A signal is sent to the controller 500 by an exerciser or trainer using a hard wired device 501 or a mobile device 502 in communication with the controller 500. The controller 500, having received the instructions from the wired device 501 or mobile device 502, directs the positions of the first actuator 503, second actuator 504, third actuator 505 and forth actuator 506 to simultaneously extend, retract or remain unchanged to therefore reposition the exercise platforms to the preferred new position. Although FIG. 19 illustrates both a wired device 501 and a mobile device 502, it should be appreciated that either may be used individually; and that the methods and systems described herein need not rely on both a wired device 501 and a mobile device 502.

FIG. 20 is an exemplary diagram of two views of an improved exercise machine 600 and table of actuator positions to change the plane of exercise. More specifically, in the embodiment in FIG. 20, various states of possible exercise machine 600 positioning are shown. For reference, a top view of an exercise machine 600 as previously described is shown supported above a base 100 by four actuators 101, 102, 103, 104.

Further, a side view of an exercise machine 600 as previously described is shown supported above a base 100 by four actuators 101, 102, 103, 104 extended to various lengths to illustrate as three examples, a first height above the floor, a second height, and a third height indicated by the dotted lines as Level 1, Level 1, and Level 3. It should be noted that, in practice, the three illustrative positions above the floor just described may be infinite within the minimum retracted length, and maximum extended length of the actuators 101, 102, 103, 104.

The opposed ends of the exercise machine 600 may be tilted up or tilted down relative to the opposed end, and the exercise machine 600 may be further rotated about the longitudinal axis of the exercise machine 600 by extending, retracting, or maintaining in a static position the actuators 101, 102, 103, 104 relative to one another.

In the table of exercise planes 508, various positions of the exercise machine 600 relative to the horizontal plane are shown. For example, to change the plane of the exercise machine 600 from the default position indicated by the row beginning with the number 0, to a new plane wherein the front left corner is lifted up relative to the back right corner of the machine, the actuators 101, 102, 103, 104 would be positioned as indicated in the row beginning with the number 3. To achieve this position, actuator 101 would remain at the default position of Level 1, actuators 102, 103, would be extended until the ends distal to the base support structure 100 were positioned at Level 2, and actuator 104 would be extended until the end distal to the base support structure 100 was positioned at Level 3. Those skilled in the art will appreciate that all actuators 101, 102, 103, 104 may move simultaneously so as not to induce unwanted torsion, compression or tensile stresses on the exercise machine 600 structure.

For efficiency, every possible relative position of the four actuators 101, 102, 103, 104 are not described, for doing so would be burdensome, however, those skilled in the art, while following the positions of the four actuators 101, 102, 103, 104 to achieve the seven illustrative positions described in the table of exercise planes 508, will appreciate the substantially large number of exercise planes possible with the systems and methods described herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine, suitable methods and materials are described above. All publications, patent applications, patents, and other references mentioned herein are incorporated by reference in their entirety to the extent allowed by applicable law and regulations. The exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise device, comprising:

a base;

an exercise machine movably connected to the base, wherein the exercise machine comprises a track, a carriage slidably connected to the track, a biasing member adapted to be connected to the carriage to apply a resistive force to the carriage, a first platform near a first end of the exercise machine and a second platform near a second end of the exercise machine, wherein an upper surface of the carriage, an upper surface of the first platform and an upper surface of the second platform are on a common plane; and a plurality of actuators connected between the base and the exercise machine, wherein each of the plurality of actuators is movably connected to the base by a first articulating connector and movably connected to the exercise machine by a second articulating connector;

wherein the plurality of actuators are operable to move the exercise machine about a first axis with respect to the base and a second axis with respect to the base, wherein the first axis is comprised of a pitch axis of the exercise machine and wherein the second axis is comprised of a roll axis of the exercise machine;

wherein the plurality of actuators comprises a first actuator, a second actuator, a third actuator and a fourth actuator;

wherein the first actuator and the third actuator are connected near the first end of the exercise machine, and wherein the second actuator and the fourth actuator are connected near the second end of the exercise machine;

wherein the first actuator and the second actuator are connected near a first side of the exercise machine, and wherein the third actuator and the fourth actuator are connected near a second side of the exercise machine;

wherein the first actuator and the third actuator are adapted to together lift and lower the first end of the exercise machine, and wherein the second actuator and the fourth actuator are adapted to together lift and lower the second end of the exercise machine;

wherein the first actuator, the second actuator, the third actuator and the fourth actuator are adapted to together lift and lower the exercise machine along a vertical axis at a constant angle of inclination;

wherein the first actuator and the third actuator each extend outwardly from the base toward the first end of the exercise machine; and wherein the second actuator and the fourth actuator each extend outwardly from the base toward the second end of the exercise machine.

2. The exercise device of claim 1, wherein the first actuator and the second actuator are adapted to together move the exercise machine about the roll axis of the exercise machine.

3. The exercise device of claim 2, wherein the third actuator and the fourth actuator are adapted to together move the exercise machine about the roll axis of the exercise machine.

4. The exercise device of claim 3, wherein the first actuator and the third actuator are adapted to together move the exercise machine about the pitch axis of the exercise machine.

5. The exercise device of claim 4, wherein the second actuator and the fourth actuator are adapted to together move the exercise machine about the pitch axis of the exercise machine.

6. The exercise device of claim 1, wherein the first actuator and the third actuator are adapted to together move the exercise machine about the pitch axis of the exercise machine.

7. The exercise device of claim 6, wherein the second actuator and the fourth actuator are adapted to together move the exercise machine about the pitch axis of the exercise machine.

8. The exercise device of claim 1, further comprising a controller in communication with each of the plurality of actuators, wherein the controller is adapted to adjust each of the plurality of actuators.

9. The exercise device of claim 8, further comprising a mobile device in communication with the controller, wherein the mobile device is adapted to transmit a signal to the controller for adjusting each of the plurality of actuators.

10. The exercise device of claim 1, wherein extension of each of the plurality of actuators is operable to lift the exercise machine with respect to the base.

11. The exercise device of claim 1, wherein retraction of each of the plurality of actuators is operable to lower the exercise machine with respect to the base.

12. The exercise device of claim 1, wherein the base includes a first end and a second end opposite of the first end, wherein the first actuator and the third actuator are connected to the base near the first end of the base, and wherein the second actuator and the fourth actuator are connected to the base near the second end of the base.

13. The exercise device of claim 1, wherein the first actuator and the third actuator each extend outwardly from the base toward the first end of the exercise machine at an upward angle, and wherein the second actuator and the fourth actuator each extend outwardly from the base toward the second end of the exercise machine at an upward angle.

14. A method of exercising on the exercise device of claim 1, comprising:

moving the exercise machine about the first axis in a first direction to a first position;

performing a first exercise by an exerciser during or after the step of moving the exercise machine about the first axis;

moving the exercise machine about the second axis in a second direction to a second position, and wherein the second position has a different attitude with respect to the first position; and performing a second exercise by the exerciser during or after the step of moving the exercise machine about the second axis.

15. A method of exercising on the exercise device of claim 1, comprising:

lowering the exercise machine along the vertical axis with respect to the base to a lowered position;

performing a first exercise by an exerciser during or after the step of lowering the exercise machine;

raising the exercise machine along the vertical axis with respect to the base to a raised position; and performing a second exercise by the exerciser during or after the step of raising the exercise machine.

16. An exercise device, comprising:

a base;

an exercise machine movably connected to the base, wherein the exercise machine comprises a track, a carriage slidably connected to the track, and a biasing member adapted to be connected to the carriage to apply a resistive force to the carriage; and a plurality of actuators connected between the base and the exercise machine, wherein each of the plurality of actuators is movably connected to the base by a first articulating connector and movably connected to the exercise machine by a second articulating connector;

wherein the plurality of actuators are operable to move the exercise machine about a first axis with respect to the base and a second axis with respect to the base, wherein the first axis is comprised of a pitch axis of the exercise machine and wherein the second axis is comprised of a roll axis of the exercise machine;

wherein the plurality of actuators comprises a first actuator, a second actuator, a third actuator and a fourth actuator;

wherein the first actuator and the third actuator are connected near a first end of the exercise machine, and wherein the second actuator and the fourth actuator are connected near a second end of the exercise machine;

wherein the first actuator and the second actuator are connected near a first side of the exercise machine, and wherein the third actuator and the fourth actuator are connected near a second side of the exercise machine;

wherein the first actuator and the third actuator are adapted to together lift and lower the first end of the exercise machine, and wherein the second actuator and the fourth actuator are adapted to together lift and lower the second end of the exercise machine;

wherein the first actuator and the third actuator each extend outwardly from the base toward the first end of at an upward angle;

wherein the second actuator and the fourth actuator each extend outwardly from the base toward the second end of at an upward angle;

wherein extension of each of the plurality of actuators is operable to lift the exercise machine with respect to the base, and wherein retraction of each of the plurality of actuators is operable to lower the exercise machine with respect to the base;

wherein the first actuator and the second actuator are adapted to together move the exercise machine about the roll axis of the exercise machine, and wherein the third actuator and the fourth actuator are adapted to together move the exercise machine about the roll axis of the exercise machine;

wherein the first actuator and the third actuator are adapted to together move the exercise machine about the pitch axis of the exercise machine, and wherein the second actuator and the fourth actuator are adapted to together move the exercise machine about the pitch axis of the; and wherein the plurality of actuators are adapted to together lift and lower the exercise machine along a vertical axis at a constant angle of inclination.

17. The exercise device of claim 16, wherein the exercise machine further comprises a first platform near the first end of the exercise machine and a second platform near the second end of the exercise machine.

18. The exercise device of claim 16, wherein the base includes a first end and a second end opposite of the first end, wherein the first actuator and the third actuator are connected to the base near the first end of the base, and wherein the second actuator and the fourth actuator are connected to the base near the second end of the base.

19. An exercise device, comprising:

a base;

an exercise machine movably connected to the base, wherein the exercise machine comprises a track, a carriage slidably connected to the track, and a biasing member adapted to be connected to the carriage to apply a resistive force to the carriage;

a plurality of actuators connected between the base and the exercise machine, wherein each of the plurality of actuators is movably connected to the base by a first articulating connector and movably connected to the exercise machine by a second articulating connector; and a controller in communication with each of the plurality of actuators, wherein the controller is adapted to adjust each of the plurality of actuators;

wherein the plurality of actuators are operable to move the exercise machine about a first axis with respect to the base and a second axis with respect to the base, wherein the first axis is comprised of a pitch axis of the exercise machine and wherein the second axis is comprised of a roll axis of the exercise machine;

wherein the plurality of actuators comprises a first actuator, a second actuator, a third actuator and a fourth actuator;

wherein the first actuator and the third actuator are connected near a first end of the exercise machine, and wherein the second actuator and the fourth actuator are connected near a second end of the exercise machine;

wherein the first actuator and the second actuator are connected near a first side of the exercise machine, and wherein the third actuator and the fourth actuator are connected near a second side of the exercise machine;

wherein the first actuator and the third actuator are adapted to together lift and lower the first end of the exercise machine, and wherein the second actuator and the fourth actuator are adapted to together lift and lower the second end of the exercise machine;

wherein the first actuator and the third actuator each extend outwardly from the base toward the first end of the exercise machine;

wherein the second actuator and the fourth actuator each extend outwardly from the base toward the second end of the exercise machine;

wherein extension of each of the plurality of actuators is operable to lift the exercise machine with respect to the base, and wherein retraction of each of the plurality of actuators is operable to lower the exercise machine with respect to the base;

wherein the first actuator and the second actuator are adapted to together move the exercise machine about the roll axis of the exercise machine, and wherein the third actuator and the fourth actuator are adapted to together move the exercise machine about the roll axis of the exercise machine;

wherein the first actuator and the third actuator are adapted to together move the exercise machine about the pitch axis of the exercise machine, and wherein the second actuator and the fourth actuator are adapted to together move the exercise machine about the pitch axis of the exercise machine;

wherein the first actuator and the third actuator each extend outwardly from the base toward the first end of the exercise machine at an upward angle, and wherein the second actuator and the fourth actuator each extend outwardly from the base toward the second end of the exercise machine at an; and wherein the plurality of actuators are adapted to together lift and lower the exercise machine along a vertical axis at a constant angle of inclination.

* * * * *